US006284965B1

(12) United States Patent
Smith, III et al.

(10) Patent No.: US 6,284,965 B1
(45) **Date of Patent: *Sep. 4, 2001**

(54) PHYSICAL MODEL MUSICAL TONE SYNTHESIS SYSTEM EMPLOYING TRUNCATED RECURSIVE FILTERS

(75) Inventors: Julius O. Smith, III, Palo Alto, CA (US); Maarten Van Walstijn, Edinburgh (GB)

(73) Assignee: Staccato Systems Inc., Mountain View, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/314,609

(22) Filed: May 19, 1999

Related U.S. Application Data

(60) Provisional application No. 60/085,960, filed on May 19, 1998.

(51) Int. Cl.[7] ..... G10H 1/12; G10H 5/00

(52) U.S. Cl. ..... 84/661; 84/622; 84/659; 84/DIG. 9

(58) Field of Search ..... 84/622–625, 659–661, 84/DIG. 9

(56) References Cited

U.S. PATENT DOCUMENTS 5,212,334 * 5/1993 Smith, III ..... 84/622
5,448,010 * 9/1995 Smith, III ..... 84/622
5,548,543 * 8/1996 Wang ..... 364/724.16
5,578,780 * 11/1996 Wachi ..... 84/659
5,740,716 * 4/1998 Stilson ..... 84/661
5,777,255 * 7/1998 Smith, III et al. ..... 84/661

OTHER PUBLICATIONS

N. Amir, G. Rosenhouse, and U. Shimony, "Discrete model for tubular acoustic systems with varying cross section—the direct and inverse problems. Part I: Theory," ACTA Acustica, vol. 81, pp. 450–460, 1995.*

R.D. Ayers, L.J. Eliason, and D. Mahgerefteh, "The conical bore in musical acoustics," American Journal of Physics, vol. 53, pp. 528–537 Jun. 1985.*

A.H. Benade and E.V. Jansson, "On plane and Spherical waves in horns with nonuniform flare. I. Theory of radiation, resonance frequencies, and mode conversion," Acustica, vol. 31, No. 2, 99. 80–98, 1974.*

E.V. Jansson, and A.H. Benade, "On Plane and Spherical Waves in Horns with Non–Uniform Flare II. Prediction and Measurements of Resonance Frequencies and Radiation Losses" Acustica,, vol. 31 (4), 185–202, pp. 235–251, 1974.*

(List continued on next page.)

*Primary Examiner*—David Martin
*Assistant Examiner*—Marlon Fletcher
(74) *Attorney, Agent, or Firm*—Lumen Intelluctual Property Services

(57) ABSTRACT

A tone synthesis system employs digital filtering methods to enable the practical usage of unstable filter elements in a real-time synthesis model. Truncated infinite impulse response (TIIR) filters are used to approximate portions of the reflection impulse response of an acoustic horn such as a trumpet bell. Methods for resetting filter state enable the use of internal unstable filter poles. Similar state resetting methods enable the use of unstable one-pole filters in the scattering junction formed between two conical acoustic bores. High quality tone synthesis can be achieved without the necessity of a complicated filter representing large sections of the bore of a woodwind instrument.

22 Claims, 10 Drawing Sheets

OTHER PUBLICATIONS

P.R. Cook, "Synthesis toolkit in C++, version 1.0," in SIGGRAPH Proceedings, Assoc, Comp. Mach., May 1996.*

J. Gilbert, J. Kergomard, and J.D. Polack, "On the reflection functions associated with Discontinuities in conical bores," J. Acoustical Soc. Of America, vol. 87, pp. 1773–1780, Apr. 1990.*

J. Martinez and J. Agullo, "Conical Bores, part I: Reflection functions Associated with Discontinuities," J. Acoustical Soc. Of America, vol. 84, 99. 1613–1619, Nov. 1988.*

D.B. Sharp, Acoustic Pulse Reflectometry for the Measurement of Musical Wind Instruments. PhD thesis, Dept. of Physics and Astronomy, University of Edinburgh 1996.*

J.O. Smith, "Music applications of digital waveguides," Tech. Rep. STAN–M–39, CCRMA Music Dept., Stanford University, 1987.*

J.O. Smith, "Waveguide simulation of non–cylindrical acoustic tubes," in Proc. 1991 Int. Computer Music Conf., Montreal, pp. 3004–3307, Computer Music Assciation, 1991.*

J.O. Smith, "Physical modeling using digital waveguides," Computer Music J., vol. 16 pp, 74–91 Winter 1992.*

J.O. Smith, "Physical modeling synthesis update," Computer Music J., vol. 20, 99. 44–56, Summer 1996.*

V. Valimaki, Discrete–Time Modeling of Acoustic Tubes Using Fractional Delay Filters PhD thesis, Report No. 3, Helsinki University of Technology, Faculty of Elec. Eng., Lab. Of Acoustic and Audio Signal Processing, Espoo, Finland, Dec. 1995.*

V. Valimaki and M. Karjalainen, "Digital waveguide modeling of wind instrument bores constructed of truncated cones," in Proc. 1994 int. Computer Music Conf., Arthus, pp. 423–430, Computer Music Association, 1994.*

M. van Walstijn, and V. Valimaki, "Digital waveguide modeling of flared acoustical tubes," in Proc. 1997 Int. Computer Music Conf., Greece, (Thessaloniki, Greece), pp. 196–199, Computer Music Association, 1997.*

M. van Walstijn, and J.O. Smith III, "Use of Truncated Infinite Impulse Response (THR) Filters in Implementing Efficient Digital Waveguide Models of Flared Horns and Piecewise Conical Bores with Unstable one–Pole Filter Elements," in Proc., Int. Symp. Musical Acoustics (ISMA–98), (Leavenworth, Washington), pp. 309–314, Acoustical Society of Acoustical Society of America, Jun. 28, 1998.*

A. Wang and J.O. Smith, "On fast FIR filters implemented as tail–canceling HR filters," IEEE Trans, Signal Processing, vol. 45. pp. 1415–1427, Jun. 1997.*

Parks, T.W. and Burrus, C.S., "Direct Frequency–Domain IIR Filter Design Methods" pp. 218–231, Digital Filter Design, John–Wiley & Sons, 1987.*

Markel, J.D. and Gray, A.H. Jr., "A General Synsthesis Structure" pp. 113–127, Linear Prediction of Speech, Spring–Verlag Berlin Heidelberg, 1976.*

G.P. Scavone, "An Acoustic Analysis of Single–Reed Woodwind Instruments with an Emphasis on Design and Performance Issues and Digital Waveguide Modeling Techniques." Ph.D. Thesis, CCRMA, Music Dept., Stanford University, Mar. 1997.*

J.O. Smith and G. Scavone, "The one–filter Keefe clarinet tonehole," in Proc. IEEE Workshop on Appl. Signal Processing to Audio and Acoustics, New Paltz, NY, (New York) IEEE Press, Oct. 1997.*

* cited by examiner $Running_1(n) = Warm(n)\ 1 - Select(n)$ $Blank_1(n) = Warm(n)\ \&\ Select(n)$ $Running_2(n) = -Warm(n)\ 1\ Select(n)$ $Blank_2(n) = -Warm(n)\ \&\ -Select(n)$

=

PHYSICAL MODEL MUSICAL TONE SYNTHESIS SYSTEM EMPLOYING TRUNCATED RECURSIVE FILTERS

CROSS-REFERENCE TO RELATED APPLICATIONS

This application claims priority from U.S. Provisional Patent Application 60/085,960 filed May 19, 1998, which is incorporated herein by reference.

FIELD OF THE INVENTION

The present invention relates to musical tone synthesis techniques. More particularly, the present invention relates to what is known as "physical-modeling synthesis" in which tones are synthesized in accordance with the mechanisms which occur in natural musical instruments. Such synthesis techniques are particularly useful for simulation of wind instruments and string instruments. By accurately simulating the physical phenomena of sound production in a natural musical instrument, an electronic musical instrument is capable of providing high quality tones.

BACKGROUND OF THE INVENTION

In the case of a wind instrument, the structure for synthesizing tones typically includes a filtered delay loop, i.e., a closed loop which includes a delay having a length corresponding to one period of the tone to be generated, and a filter which may attenuate and/or further delay signals circulating in the loop.

When the acoustic bore being imitated is not a uniform cylinder or cone, a plurality of closed loops are typically employed. Each closed loop corresponds to a single section of uniform cylindrical or conical acoustic tube, and the sections are coupled together by means of so-called scattering junctions. In the case of two adjacent acoustic tube sections having different diameters or different conical taper angles at the point of contact, the corresponding scattering junction typically receives an input signal from each section and provides an output signal to each section. The output to each section typically includes a filtering of the input signal from that section, called the reflected signal, and it typically also includes a filtering of the input signal from the adjacent section, called the transmitted signal from the adjacent section.

To excite a filtered delay loop with an input signal, a filtered delay loop may be coupled to a nonlinear junction which receives control inputs such as a signals corresponding to blowing pressure and embouchure, and which nonlinearly interacts with the signal received from the filtered delay loop so as to produce a sustained oscillation in the loop. The nonlinear junction typically corresponds to the reed in a woodwind instrument, the air-jet in a flute-like instrument, or the lips in a brass instrument.

Excitation signals introduced into a closed loop circulate in the loop. A signal may be extracted from the loop to form a tone signal. The signal will decay in accordance with the filtering characteristics in the loop. Additionally, the resonance frequencies of the loop are also affected by the filtering characteristics. The filter models frequency-dependent losses and delays within the bore of the instrument. A portion of these losses correspond to sound propagating out of the the bell or toneholes of the instrument. Other losses may correspond to the conversion of acoustic wave energy to heat. A portion of the frequency-dependent delay may correspond to the different effective tube length at the end of an open acoustic tube. More generally, acoustical waves experience partial reflection and dispersion when they encounter changes in the flare angle of the acoustic tube in which they propagate. In order to accurately model a natural musical instrument, therefore, it has been necessary to provide one or more filters in the filtered delay loop which give the desired losses, dispersion, and reflections found in a natural acoustic wind instrument.

A block diagram for a tone synthesis system as described above is illustrated in FIG. 1B for the case of a brass-type instrument shown in FIG. 1A. The instrument in this example consists of a mouthpiece 2 driven by the player's lips 1, a first conical bore section 3, a cylindrical bore section 4, a second conical bore section 5, and a final flaring bell segment 6. Since cylindrical and conical bores support traveling waves, the sound within them can be expressed in terms of left-going and right-going traveling-wave components. The right-going traveling-wave components in the cylindrical section, for example, correspond to the contents of delay element 16, and the left-going traveling-wave components in the cylindrical section correspond to the contents of delay element 17.

The cylindrical section 4 can be modeled well as simply a pair of delay elements. In reality there are small losses associated with acoustic propagation from one end of the cylinder to the other. However, for greater processing efficiency, such losses are typically applied elsewhere, such as at the junctions 7 and/or 8 between the cylinder and the adjacent acoustic tube sections.

As is known in the art, the conical sections 3 and 5 can also be modeled as a pair of delay elements. However, in this case, pressure waves traveling to the right are attenuated by 1/x, where x is the distance of the wave from the extrapolated apex of the cone containing the conical section.

When a right-going traveling wave encounters the bell 6, a portion of it transmits through the bell into the outside air (which can be heard), and a portion of it reflects back into the bore 5 to help sustain the oscillation. This reflected signal is obtained by applying lowpass filter 13 to the right-going traveling-wave-component signal 30 to obtain the corresponding reflected wave 31 which then becomes the left-going traveling-wave-component signal entering the conical section 5 on its right side. The signal transmitted from the bell may be obtained by applying a transmission filter 61, which typically resembles a highpass filter, to the incident right-going wave 30 to obtain the final output tone signal. A simple implementation of the the output highpass filter (transmission filter) is formed by simply adding the pressure-wave signals 30 and 31, corresponding to a lossless bell model, with a microphone placement just outside the bell. (For pressure waves, the reflection filter 13 inverts at low frequencies.) In simplified tone generators, any traveling-wave component, such as 30, can be taken as the output signal.

In a manner analogous to the bell reflection just described, when a right-going traveling-wave 40 in the cylindrical section encounters a change 7 in the taper angle of the bore, it splits into a reflected signal 41 and transmitted signal 42. The reflected signal 41 is obtained by applying the reflection filter 18 to the incident wave 40, and the transmitted signal 42 is obtained by applying the transmission filter 43 to the incident wave 40. It is well known in the art that the ideal reflection filter 18 has the transfer function $$R(s) = -\frac{c}{c + 2xs},$$

where c is the speed of sound, x is the distance from the apex of the conical segment 5 (which must be extrapolated far to the left in FIG. 1A) to the junction 7, and s is the Laplace-transform variable. For very large wavelengths, the imaginary part of s is close to zero, and the reflection filter becomes close to a simple inverting reflection R(0)=−1.

It is known in the art that the reflection filter 14, for waves 32 traveling in from the other side of the junction, has the same transfer function R(s). Finally, it is also known that the transmission is filters 43 and 44 both have the transfer function $$T(s)=1+R(s).$$

A filtered delay loop 10 is formed by delay elements 11 and 12, lowpass filter 13, and reflection filter 14. Input signals are introduced in to this filtered delay loop by means of adder 15. The delay elements 11 and 12 are normally combined into a single delay element for greater efficiency, as is known.

A second filtered delay loop is formed by delay elements 16 and 17, reflection filter 18, and reflection filter 23. Input signals are introduced in to this filtered delay loop by means of adder 25 and adder 45. The delay elements 16 and 17 can also be combined into a single delay element for greater efficiency.

A third filtered delay loop is comprised of delay elements 51 and 52, reflection filter 21, and a port connecting to the nonlinear junction 53. Excitation signals enter this circulating signal path via adder 26 and the nonlinear junction 53.

The sum of the lengths of all of the delay elements 11, 12, 16, 17, 51, and 52 are approximately equal to the pitch period of the synthesized tone.

The general function of the nonlinear junction 53 is to sustain the oscillations of the synthesized tone. The input embouchure signal 56 is a typical control input corresponding to the way the player's lips are pressed against the mouthpiece before and during the performance of a musical note. The input pressure signal 55 corresponds to the air pressure in the player's mouth at the lips, and it is the primary control signal which starts and drives the oscillation in the filtered delay loops. Signal combining means used in nonlinear junctions remain subjects of ongoing research, but many cases have been described in the art.

In a MIDI keyboard type of synthesizer, the embouchure signal 56 may be obtained from a modulation wheel, while the pressure signal 55 may be obtained from a breath controller. Key-velocity may be used to influence the attack shape of the pressure signal, and after-touch may be used to control vibrato, and so on. The key-number determines the pitch period which is controlled by appropriately changing of one or more of the delay element lengths. In a wind controller type of interface, the actual breath pressure and embouchure of the wind-controller player may be measured, appropriately scaled, and provided as control inputs for the nonlinear junction 53.

A scattering junction 20, corresponding to the junction between conical section 3 and cylindrical section 4, is comprised of the reflection filter 21, transmission filter 22, reflection filter 23, transmission filter 24, and adders 25 and 26. Adder 25 combines the transmitted signal leaving conical section 3 with the signal reflecting back into the cylindrical section 4. Adder 26 similarly combines the transmitted and reflected signals which are both going to the left into conical section 3. As is known in the art, it is possible to implement the scattering junction 20 using only the reflection filter 21 and three adders. However, such variations, which result from the special structure of the reflection and transmission filters described above, are well known and need not concern us here. FIG. 1B is drawn instead to illustrate more clearly the correspondence between the signal processing elements of the tone synthesizer and the acoustical elements of the physical instrument shown in FIG. 1A.

A second scattering junction 60, corresponding to the junction between cylindrical section 4 and conical section 5, consists of reflection filter 18, transmission filter 43, reflection filter 14, transmission filter 44, and adders 15 and 45.

Finally, note that the reflection and transmission filtering associated with the bell can be regarded as a scattering junction 62 in which waves traveling into the bell from the right are neglected. More generally, any section of an arbitrary acoustic tube can be characterized as a scattering junction containing two reflection and two transmission filters; the only difference relative to the simpler cylinder-cone scattering junction 60, for example, is that the reflection and transmission filters are no longer one-pole filters, but may have arbitrarily high order. Nevertheless, it is an important general principle, known in the art, that such a scattering representation exists when an acoustic tube profile is neither cylindrical nor conical, but rather follows some other more complicated shape.

The system of FIG. 1B illustrates the essential ingredients for high quality tone synthesis of a wind musical instrument. In a similar manner, using the elements described in this example, tone synthesis processing can be defined for all kinds of wind instruments. In general, every change in conical taper-angle in a wind instrument bore can be modeled as a scattering junction which is in turn characterized by a specific one-pole filter, and every non-conical, non-cylindrical bore section can be modeled as a scattering junction comprised of reflection and transmission filters which are generally high-order filters. Uniform conical and cylindrical sections are modeled simply as delay elements, and the junctions between these elements involve one-pole (first order) reflection and transmission filters.

There is one serious practical difficulty in the general tone synthesis framework illustrated in FIG. 1B. As described above, the scattering junction 60 is characterized by the reflection filter R(s)=−c/(c+2xs), where x is the distance from the junction 7 to the extrapolated apex of the conical section 5. Since x>0, the pole of the filter R(s) is at s=−c/(2x), which is in the left-half s-plane. As is well known, this corresponds to a stable one-pole filter. The scattering junction 20, on the other hand, is characterized by the reflection filter R(s)=−c/(c−2ys), where y is the distance from the junction 8 to the apex of the cone determined by conical section 3. In this case, the pole is at s=c/2y which is in the right-half s-plane, which corresponds to an unstable one-pole filter. It is known in the art that the reflection and transmission filters associated with a change in conical taper angle are unstable whenever the taper-angle is decreasing. At the left cone-cylinder junction 8, the taper angle changes from positive to zero for right-going waves, i.e., decreasing, resulting in unstable reflection and transmission filters. Similarly, for left-going waves incident on the junction 8, the taper angle changes from zero to negative, again decreasing, and again resulting in unstable reflection and transmission filters. At the right cylinder-cone junction 7, the taper angle changes from zero to positive for right-going waves, resulting in stable reflection and transmission filters, and so on. Since the physical instrument is passive and cannot create energy, every unstable pole in the model must be canceled by a zero within the context of the overall system. However, as is well known in the field of control systems, it is not feasible in finite-precision practical implementations to attempt to cancel an unstable pole with a zero. This situation prevents straightforward application of the modeling principles outlined above. One way this difficulty has been addressed in practice is to combine adjacent tube sections in order to avoid use of unstable poles. In the example of FIGS. 1A and 1B, only junction 8 contains unstable components, and creating a combined high-order scattering junction including the tube sections 3 and 4, thus collapsing junctions 9 and 7 into a single very-high-order junction (characterized by its two-by-two scattering matrix transfer function), unstable poles are avoided. However, this adds greatly to the computational expense, and inhibits further model extensions, such as the introduction of a register hole in tube section 2, because plural physical elements (two acoustic tubes in this case) are being combined into a single mathematical abstraction.

A second drawback in tone synthesis systems such as illustrated in FIGS. 1A and 1B is that flaring tube sections such as the bell 6 require very high-order filters, leading to high expense in the implementation. For example, a straightforward discrete-time model of the bell is to use its sampled reflection impulse response ("reflectance") as a convolution filter. This yields a trivially designed finite-impulse-response (FIR) filter model for the reflectance. As a specific example, an empirically derived trumpet-bell reflectance was found to have an impulse response duration on the order of 10 ms which is on the order of 400 samples at a 44.1 kHz sampling rate. While a length 400 FIR filter can faithfully model the trumpet-bell reflectance, such a filter requires 400 multiply-adds per sample of digital sound generated by the synthesizer, and this is far more expensive computationally than the other components of a trumpet model. The one-pole filter 21 in the cone-cylinder junction, by contrast, requires only one multiply-add per sample.

Tone synthesis systems such as illustrated in FIGS. 1A and 1B may be implemented in hardware, although it is somewhat more common presently to implement them in software utilizing one or more digital signal processing (DSP) chips. In recent years, it has additionally become feasible to implement complete tone synthesizers such as depicted in FIG. 1B entirely in software on a general purpose personal computer. For example, there are presently many "software synthesizer" products available for the Windows operating environment which run entirely on the general purpose Pentium processor, requiring no special hardware beyond the standard sound support.

Because tone synthesis systems are being deployed more and more in the form of software on general purpose personal computers, it is highly desirable to find ways to reduce the computational expense of the reflection and transmission filters associated with non-conical, non-cylindrical acoustic tube segments.

Instead of using the sampled bell reflectance as a large FIR convolution filter, an infinite-impulse-response (IIR) digital filter can be designed to approximate the bell reflection response. It is known in the art that IIR filters can generally approximate a given impulse response with much less computation than an FIR filter because IIR filters are recursive. The recursive filter-design method used to produce an IIR filter from the measured bell reflectance should faithfully match the phase of the bell reflection frequency response (the "phase reflectance"), because that affects the tuning of the horn resonances. The filter-design method must also match well the magnitude of the bell reflection frequency response (the "amplitude reflectance") because that strongly affects the strength ("Q") of the horn resonances. However, known phase-sensitive IIR filter-design methods perform poorly when applied to a measured bell reflectance. This is due mainly to the long, slowly rising, quasi-exponential portion of the time-domain response, arising from the smoothly flaring bore profile that is characteristic of musical horns. As a result, there is a need for more effective digital filter design techniques in this context.

SUMMARY OF THE INVENTION

The present invention provides a physical model tone synthesis system in which high quality tones can be synthesized without the necessity of an expensive bell filter and without numerical failures caused by unstable filter elements. The computational complexity of the bell filter in a trumpet model, for example, is reduced by more than an order of magnitude while accurately preserving the horn resonances. Unstable filter elements are dealt with by periodically clearing their state in order to prevent the build-up of round-off error. This is made possible by starting up a new instance of each unstable model element in parallel with the existing one, letting it run in parallel until its output is the same (ignoring round-off error), and instantaneously switching it in as a replacement for the existing model element. Since the replacement elements can be switched in at intervals which are long relative to the start-up time of a fresh element, the computational cost is much less than twice that of the one element. The present invention thus describes a high quality tone synthesis system for wind instruments which is much less costly than those in the prior art.

Inspections of horn reflectances in the time domain suggest that a natural modeling approach might consist of dividing the impulse response into at least two sections: an initial growing exponential, followed by a more oscillatory "tail." The tail can be faithfully modeled using more conventional filter-design methods. The most efficient way to model a growing exponential is by means of an unstable one-pole filter, just as we encounter in piecewise conical acoustic tubes. Thus, both the problems of modeling flared horns and piecewise conical bores give rise to the problem of how to utilize unstable digital filters as modeling elements without running into numerical problems.

It turns out that growing exponential impulse-response segments can be efficiently and practically devised using known "Truncated Infinite Impulse Response" (TIIR) digital filtering techniques. The basic idea of a TIIR filter is to synthesize an FIR filter as an IIR filter minus a delayed "tail canceling" IIR filter (which has the same poles as the first). That is, the second IIR filter generates a copy of the "tail" of the first so that it can be subtracted off, thus creating an FIR filter. When all IIR poles are stable, TIIR filters are straightforward. In the unstable case, the straightforward implementation fails numerically: While the filter tails always cancel in principle, the exponential growth of the roundoff-error eventually dominates. Thus, in the unstable case, TIIR filters must switch between two alternate instances of the desired TIIR filter (i.e., two pairs of tail-canceling IIR filters). The state of the "off-duty" filter is cleared in order to zero out the accumulating round-off noise. The key observation is that, because the desired TIIR filter functions as an FIR filter, it reaches exact "steady state" after only N samples, where N is the length of the synthesized FIR filter. As a result, a "fresh instance" of the TIIR filter, when "ramped up" from the zero state, is ready to be switched in exactly after only N samples, even though the component IIR filters have not yet reached the same internal state as those of the TIIR filter being switched out.

The present invention may be implemented in hardware (e.g., using an application specific integrated circuit), or in software (e.g., using a digital signal processor or general purpose microprocessor). Thus, in one aspect of the invention, an electronic tone synthesis circuit is provided for synthesizing a tone resembling that produced by a wind instrument having an acoustic tube bore. The circuit comprises an input for receiving an excitation signal, a delay for delaying a digital signal, an infinite-impulse-response (IIR) filter for digitally filtering the digital signal, and an output for providing a digital output representing a synthesized tone. The circuit is further characterized in that the delay and filter are connected in series with feedback to form a filtered delay loop, the input injects the excitation signal into the filtered delay loop, the output extracts the digital signal from the filtered delay loop, the delay and filter introduce a total time delay of the digital signal, wherein the total time delay is inversely proportional to an approximate pitch of the synthesized tone, and the IIR filter includes at least one unstable pole. In a preferred embodiment, the circuit further comprises a filter truncation circuit for truncating an impulse response of the IIR filter after a predetermined number of samples, thereby forming a truncated infinite impulse response (TIIR) filter. The circuit may also comprise resetting circuitry to reset the filter to eliminate accumulated round-off errors arising in part from the presence of one or more unstable poles in the filter. Preferably, the resetting circuitry includes a second IIR or TIIR filter and operates only as necessary to achieve a predetermined minimal accuracy. The IIR filter preferably has an impulse response approximately equal to the sum of an exponential and a constant, or an impulse response approximately equal to a polynomial.

In another aspect of the invention, a computer implemented method is provided for electronically synthesizing a tone resembling that produced by a wind instrument having an acoustic tube bore. The method comprises providing an excitation signal (e.g., by generating, retrieving from memory, or receiving from another circuit), combining the excitation signal with a digital signal propagating in a filtered delay loop, delaying the digital signal propagating in the filtered delay loop by a total delay inversely proportional to the approximate pitch of the synthesized tone, digitally filtering the digital signal propagating in the filtered delay loop using an infinite impulse response (IIR) filter having at least one unstable pole, and outputting the digital signal from the filtered delay loop to produce the synthesized tone. Preferably, the method further comprises truncating an impulse response of the IIR filter after a predetermined number of samples, thereby implementing a truncated infinite impulse response (TIIR) filter. Digitally filtering the digital signal preferably includes repeatedly resetting the filter to eliminate accumulated round-off errors associated with the presence of one or more unstable poles in the filter. This resetting may include interchangeably using a plurality of substantially equivalent IIR or TIIR filters, and is preferably performed only as necessary to achieve a predetermined minimal accuracy. The IIR filter preferably has an impulse response approximately equal to a polynomial, or to the sum of an exponential and a constant.

DESCRIPTION OF THE DRAWINGS

The invention will be described with reference to the accompanying drawings, wherein.

DESCRIPTION OF THE PREFERRED EMBODIMENT

Figure 1A:
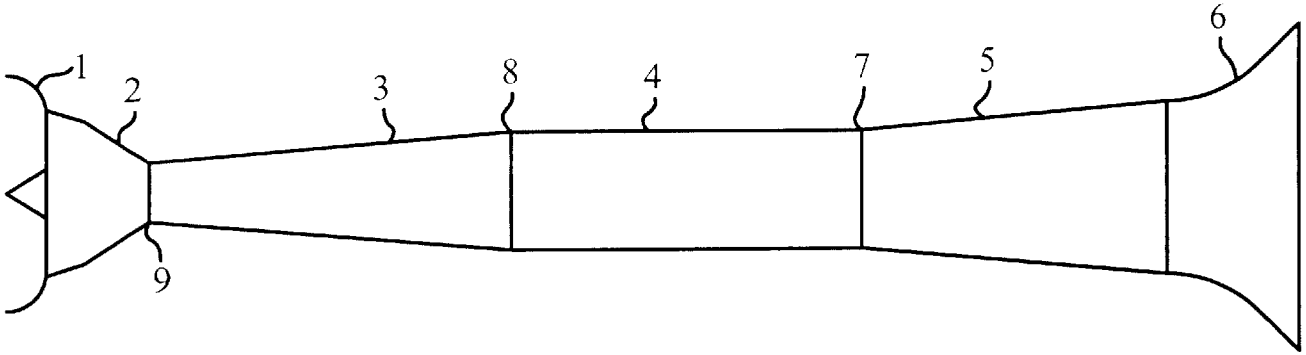
FIG. 1A is an illustration of a physical wind instrument used as the basis for constructing electronic synthesis models.
Figure 1B:
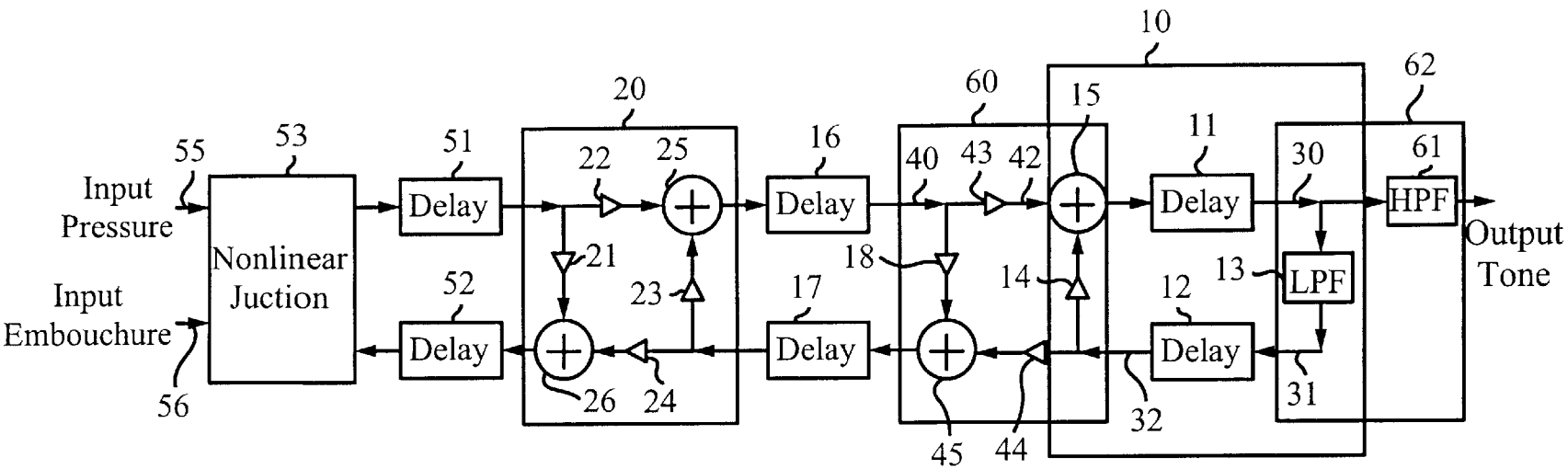
Fig. 1B Prior Art
FIG. 1B is a block diagram of a prior art tone synthesizer system employing an expensive bell reflection filter 13 and an unstable scattering junction 20.

The present invention solves the two main difficulties described above pertaining to implementing real-time physical models of acoustic instruments in accordance with the diagram of FIG. 1B. The first difficulty has to do with simulating the bell 6 of a wind instrument, and the second has to do with simulating the junction 8 between two acoustic tube sections in which the taper angle is decreasing. The first difficulty is solved using a specialized Truncated Infinite Impulse Response (TIIR) digital filter structure utilizing one unstable pole which is reset periodically in order to avoid excessive build-up of round-off error. The second difficulty is solved using a technique similar to the first in which unstable model components are periodically reset to avoid excessive build-up of round-off error. These aspects of the invention will now be described in detail, including program listings written in the C++ language in the appendices.

A One-Pole-Based TIIR filter

Figure 2:
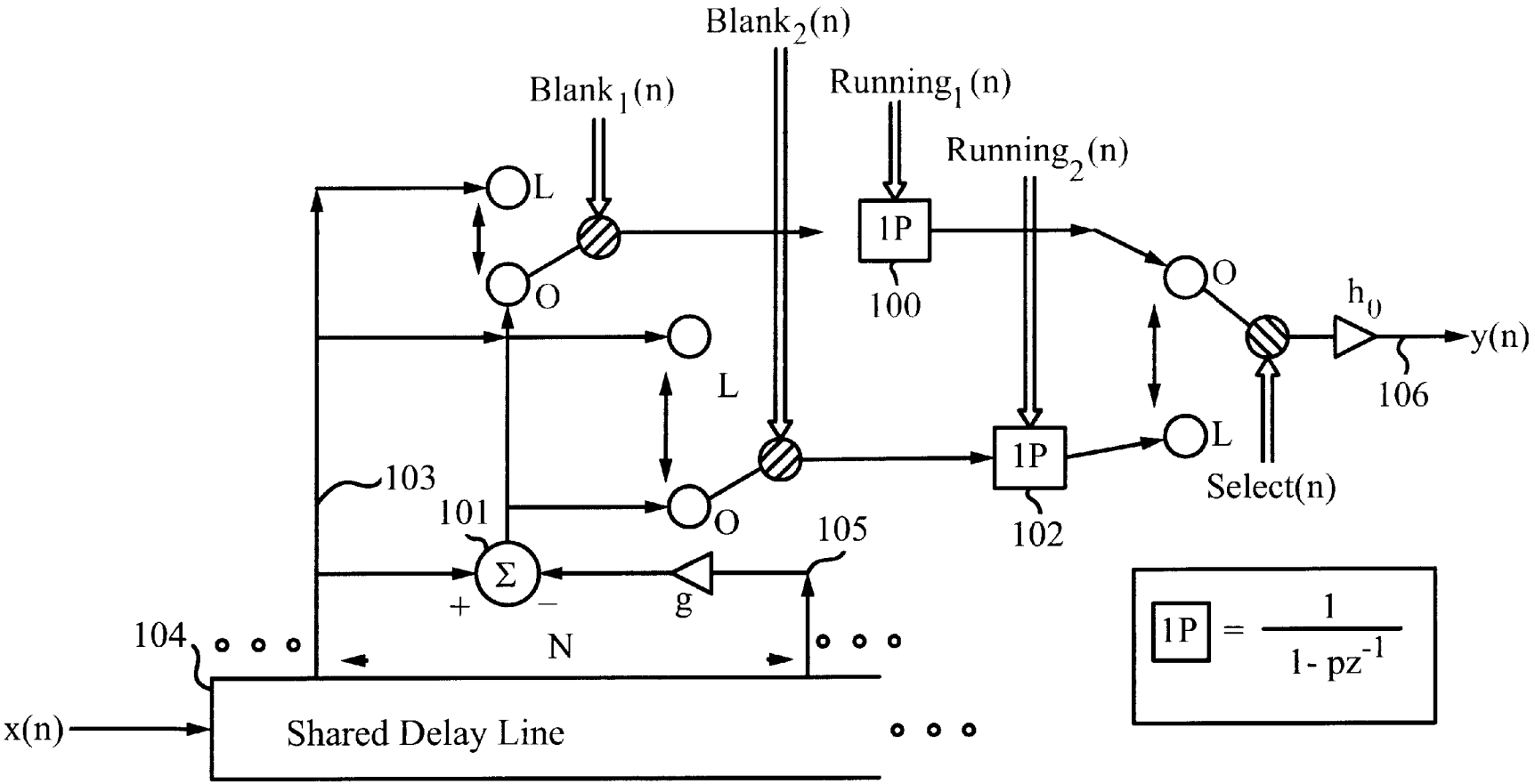
FIG. 2 is a block diagram of a TIIR digital filter which implements a truncated constant or exponential impulse response.

FIG. 2 shows a one-pole based TIIR filter developed in the course of the present invention; it can be configured to have either a truncated growing exponential or truncated constant impulse response. There are several alternative structures possible, and we believe the structure shown in FIG. 2 is preferable to the others. It is a "shared delay, shared dynamics" structure which allows use of a single delay line for any number of cascaded TIIR filter sections, and which requires only a single one-pole filter per TIIR instance. By conceptually "pushing" the one-pole filter 100 backwards through the subtraction block 101, for example, one obtains the more straightforward case of an initial one-pole filter with a second one-pole filter subtracting off the tail after a delay of N samples.

FIG. 2 illustrates the computations associated with a single one-pole TIIR filter section. The filtering characteristic implemented is that of a Finite Impulse Response (FIR) digital filter:

$$y(n) = \sum_{m=0}^{N-1} h(n)x(n-m)$$

where x(n) denotes the input signal at time sample n, y(n) denotes the output signal 106, and h(n) is the filter's impulse response, which is defined as follows:

$$h(n) = \begin{cases} h_0 p^n & \text{for } 0 \le n \le N-1 \\ 0 & \text{otherwise} \end{cases}$$

This filter is constructed as the difference of two recursive one-pole filters as follows: The TIIR filter output is $$y(n)=y_1(n)-gy_1(n-N)$$

where $y_1(n)$ is the output of a one-pole filter described by $$y_1(n)=x(n)+py_1(n-1).$$

Here, p is the pole location, and $g=p^N$ is the gain needed to obtain cancellation of the impulse-response tail. That the tail is in fact canceled can be seen by noting that the one-pole filter (connecting x(n) to $y_1(n)$) has the impulse response $$h_1(n)=p^n u(n),\ n=0, 1, 2, \ldots$$

where u(n) is the Heaviside unit-step function:

$$u(n) = \begin{cases} 1 & \text{for } n \ge 0 \\ 0 & \text{for } n < 0 \end{cases}$$

We now have $$\begin{aligned} y(n) &= y_1(n) - g \cdot y_1(n-N) \\ &= p^n u(n) - p^N \cdot p^{n-N} u(n-N) \\ &= p^n \cdot [u(n) - u(n-N)] \\ &= [1, p, p^2, \ldots, p^{N-1}]_n \\ &= \begin{cases} p^n & \text{for } 0 \le n \le N-1 \\ 0 & \text{otherwise} \end{cases} \end{aligned}$$

Thus, the difference of two one-pole filters synthesizes an FIR filter having an impulse response which is a truncated sampled exponential.

Figure 3:
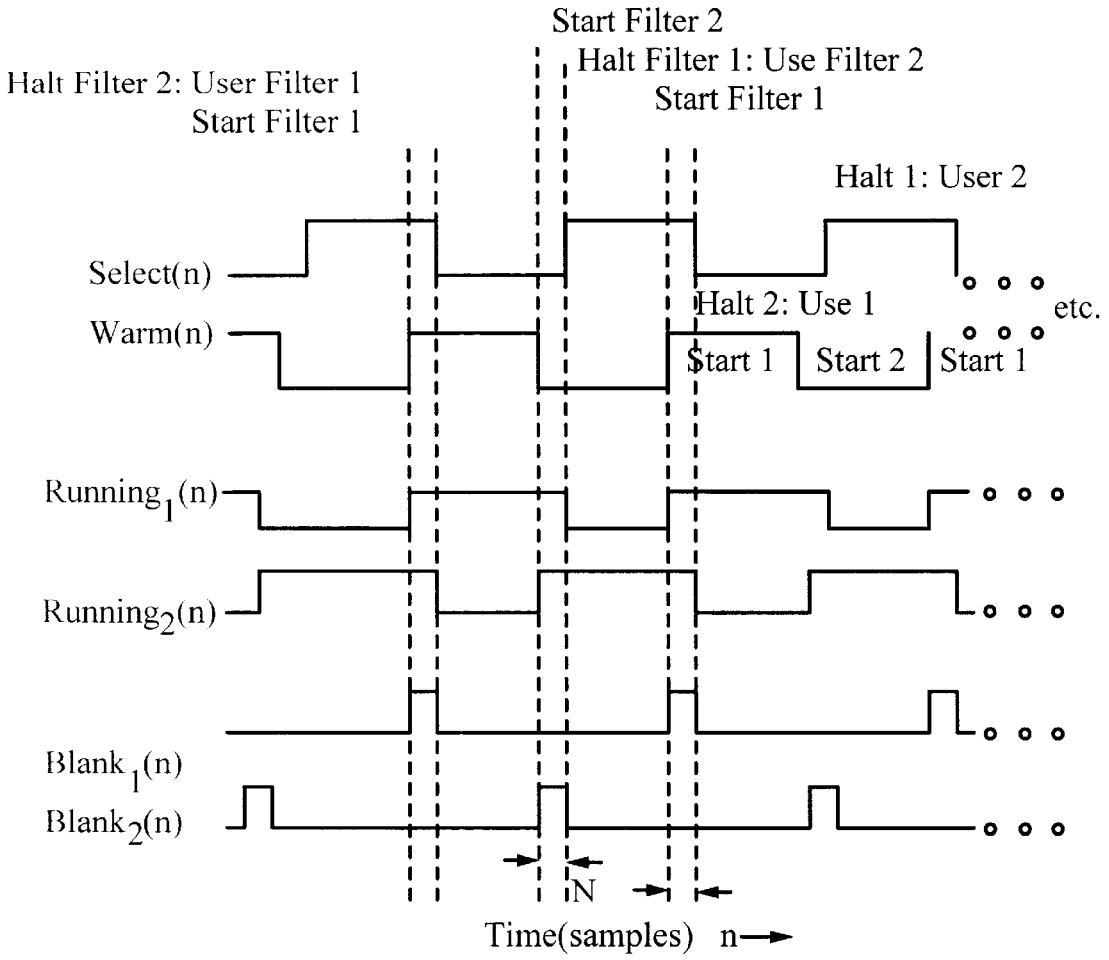
FIG. 3 is a graph of example control signals for the TIIR filter of FIG. 2.

Referring to FIGS. 2 and 3, consider when the upper one-pole filter 100 ("Filter 1") is switched in (as the figure indicates), and the lower one-pole filter 102 ("Filter 2") is switched out and not being computed at all. This situation begins after the falling edge of control signal Select(n), and ends on the falling edge of control signal Warm(n), as illustrated in FIG. 2. The next event is to tell Filter 2 to "start warming up" on the falling edge of Warm(n). "Filter warm-up" proceeds for at least N samples, where N is the length of the overall FIR filter being synthesized by the entire block diagram. During this warm-up time, the subtraction 101 must be "blanked." During a blanking interval, only the '+' input 103 of the subtractor is fed to the one-pole filter, since both inputs to the subtraction operation 101 must see the same input histories. The control signal $Blank_2(n)$ may be derived as $$Blank_2(n)=-Warm(n)\&-Select(n),$$

where "&" denotes logical "and", and "–" denotes logical negation. While $Blank_2(n)$ is high, only the input to the subtractor 101 is fed to Filter 2 (102). At other times, the output of subtractor 101 is used as the filter input. After N or more samples of warm-up, Filter 2 is ready to be switched in. This is effected in FIG. 2 by the rising edge of the Select(n) control signal. The same signal may be used to halt and clear Filter 1 (or simply not compute it in a software implementation). The same signal can also be used to end the blanking interval. A signal $Running_1(n)$ which is high only when Filter 1 is computing can be derived as $$Running_1(n)=Warm(n)|-Select(n),$$

where "|" denotes logical "or". Logic expressions for the other derived signals are given in FIG. 3. The next event, triggered by the rising edge of Warm(n), is to warm up Filter 1. After N or more samples during which it receives only the earlier signal from the delay line (the blanking interval for Filter 1 warm-up), it is switched back in, and Filter 2 is halted and cleared, and so on.

Note that the control signal Warm(n) is a low-speed, 50% duty-cycle square wave, and Select(n) can be obtained from Warm(n) by a simple delay. All other control signals are derivable from these two by elementary logic operations.

Note that, while Filter 1 will not be in the same state as Filter 2 after N times steps, its tail-canceling difference, which synthesizes an FIR filter, is identical (ignoring round-off errors). Therefore, the switching resets can be as often as every N samples. It is desirable, however, to switch much less often than every N samples in order to minimize computations. The minimum switching rate, at the other extreme, is determined by the exponential growth rate and available dynamic range. For example, if computations are being done in 32 bit fixed-point arithmetic, and the final output signal will occupy 20 bits (e.g., for high-quality digital audio), then there are 32–20=12 "guard bits" during which the round-off error may be allowed to grow. The growth rate of the round-off error is determined by the location p of the pole of the filter. The root-mean square (rms) round-off error due to a single multiplication is generally estimated to be $q/2\sqrt{3}\approx 0.3q$, where q is the quantization step size (i.e., the value of the least-significant bit). In the present example, the rms round-off error may therefore grow by approximately $2^{12}/0.3\approx 13{,}000$ before it will begin disturbing the upper 20 bits in a 32-bit fixed-point number format. Since the rms round-off error at the output of an unstable one-pole filter grows by approximately |p| each sample period, this translates to log(13,000)/log(p) samples of computation before the filter must be reset. As a specific example, suppose p=1.001, which corresponds to a one-pole filter with an impulse response that is a rising exponential with time-constant $1/\log_e(p)\approx 1/(p-1)=1000$ samples. Such an unstable one-pole filter can be computed in 32-bit fixed-point for approximately log(13,000)/log(1.001)=9,477 samples before it must be reset to avoid round-off errors accumulating into the high-order 20 bits of the output signal.

When the structure of FIG. 2 is used to implement a truncated constant impulse response, the one-pole becomes a digital integrator (no multiplies), and the tail-canceling multiply-subtract becomes only a subtraction. The digital integrator can be described by the difference equation $$y(n)=x(n)+y(n-1)$$

where x(n) denotes the input signal at time n, and y(n) denotes the output signal at time n. Resets for digital integrators can be considerably less often than for growing exponentials, because the round-off error grows more slowly in an integrator. It is well known that, given the typical assumption of uncorrelated round-off errors, the rms level of the round-off error at the output of a digital integrator grows by approximately $\sqrt{M}$ after M samples of computation. In the preceding example of a 32-bit fixed-point number format with a 20-bit final output signal, we may thus run the digital integrator for approximately $13{,}000^2=69{,}000{,}000$ samples before a reset is required.

So far we have described the operation of a single TIIR one-pole filter having an impulse response which is a truncated constant or exponential. To piece together a longer FIR impulse response consisting of several such segments, we can simply repeat the structure of FIG. 2 as many times as needed along the shared delay line 104. If FIG. 2 depicts the first segment, a second segment can be constructed immediately to its right in the figure. Note that the first segment has a first input signal 103 and a second input signal 105. The second segment's first input signal becomes signal 105, thus not requiring an additional delay-line output, or "tap", and its second input is extracted from farther down the delay line (not shown in the figure). Finally, the outputs from all of the segments are weighted by gain factors and summed to produce the complete multistage TIIR filter output.

In summary, we have described a first-order truncated infinite impulse response (TIIR) filter which is capable of providing a truncated-constant or truncated-exponential impulse response segment. Several such segments can be combined to create an FIR filter having an impulse response consisting of successive constant, exponential, or even polynomial segments. In the case of a constant or exponential, each segment can be computed at a computational cost typically close to that of a single one-pole filter, a (tail canceling) multiply-add, plus some associated switching and control logic.

A truncated $k^{th}$-order polynomial impulse response can be implemented as a linear combination of k+1 TIIR digital integrators in cascade. The output of the first integrator gives a single pole at z=1 and provides a truncated constant. The output of the second integrator exhibits two poles at z=1 and generates a truncated ramp signal. The third shows three poles at z=1 and generates a truncated quadratic signal, and so on, up to the $k+1^{st}$ which has k+1 poles at z=1 and which generates a sampled signal proportional to $n^k$. The appropriate weighted sum of the outputs of all k+1 TIIR integrators can be used to create a finite segment of any order k polynomial impulse response $$h(n)=[a_0+a_1n+a_2n^2+\ldots+a_kn^k]\cdot[u(n)-u(n-N)]$$

where u(n) denotes the Heaviside unit step function.

Appendix A provides program listings in the C++ language for implementing the TIIR filter described above. Appendix E further provide listings of the modified software utilities from the Synthesis Tool Kit (STK) used in the programming examples.

Bell Modeling

In this section, we apply the TIIR filter structure of the previous section to the problem of modeling a trumpet bell in two different cases. These examples are illustrative of the steps required in general to apply the techniques of the invention. The first example starts from a theoretical horn model, and the second example builds the computational model based on acoustic properties of a real trumpet bell measured in the laboratory.

Bell Model Based on a Theoretical Bessel Horn

A general characteristic of musically useful horns is that their internal bore profile is well approximated by a Bessel horn. Although any real instrument bell will show significant deviations from this approximation in its bore shape and acoustic reflectance, a theoretically derived Bessel horn reflection function may serve as a suitable generalized target response. In order to obtain such a target response, the pressure reflectance of a Bessel horn that approximates the shape of a trumpet bell was computed using a pulse reflectometry method. This method is based on a discretization of the horn into segments of equal lengths and constant flare rate. The influence of the radiation impedance on the reflectance, which is relatively small in the case of strongly flared musical horns, was neglected.

As shown in FIG. 5, the Bessel horn reflection impulse response has a slow, quasi-exponentionally growing portion at the beginning, corresponding to the smoothly increasing taper angle of the horn. Phase-sensitive digital filter design methods perform very poorly when applied to the theoretical bell reflectance due to the very slow build-up in the time domain. A one-pole TIIR filter gives a truncated exponential impulse response $h(n)=ae^{cn}$, for n=0, 1, 2, . . . , N−1, and zero afterwards. We can use this truncated exponential to efficiently implement the initial growing trend in the horn response (c>0). We found empirically that improved accuracy is obtained by using the sum of an exponential and a constant, i.e., $$h(n)=\begin{cases} ae^{cn}+b & \text{for } n=0,1,2,\ldots,N-1 \\ 0 & \text{otherwise} \end{cases}$$

We will refer to this construct as an offset exponential. The truncated-constant b can be generated from a second one-pole TIIR filter with its pole set to z=1. In this case, the only multiply needed is the scale factor b.

The complete transfer function of the TIIR filter which models a single segment of the horn impulse response as an offset exponential can be written as $$H(z)=h_0\frac{1-p^Nz^{-N}}{1-pz^{-1}}+b\frac{1-z^{-N}}{1-z^{-1}} \tag{1}$$

Figure 4:
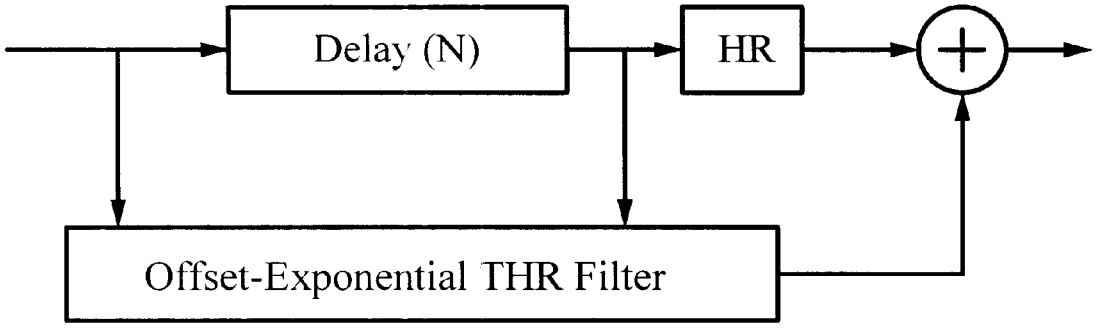
FIG. 4 is a block diagram of a TIIR horn filter structure.

The remaining reflection impulse response has a decaying trend, and can therefore be modeled accurately with one of many conventional filter design techniques. The filter design method should accurately capture both the magnitude and phase of the desired frequency response. Here, the known Steiglitz-McBride IIR filter design algorithm was applied (see, e.g., the stmcb() function in Matlab). The complete filter structure can be realized with a single delay-line, as shown in FIG. 4. Alternatively, the remaining response may be further divided into an exponentially decaying tail (modeled with eq. (1)) and a middle segment that contains the main 'swing' (approximated as a truncated cubic polynomial).

Figure 5A:
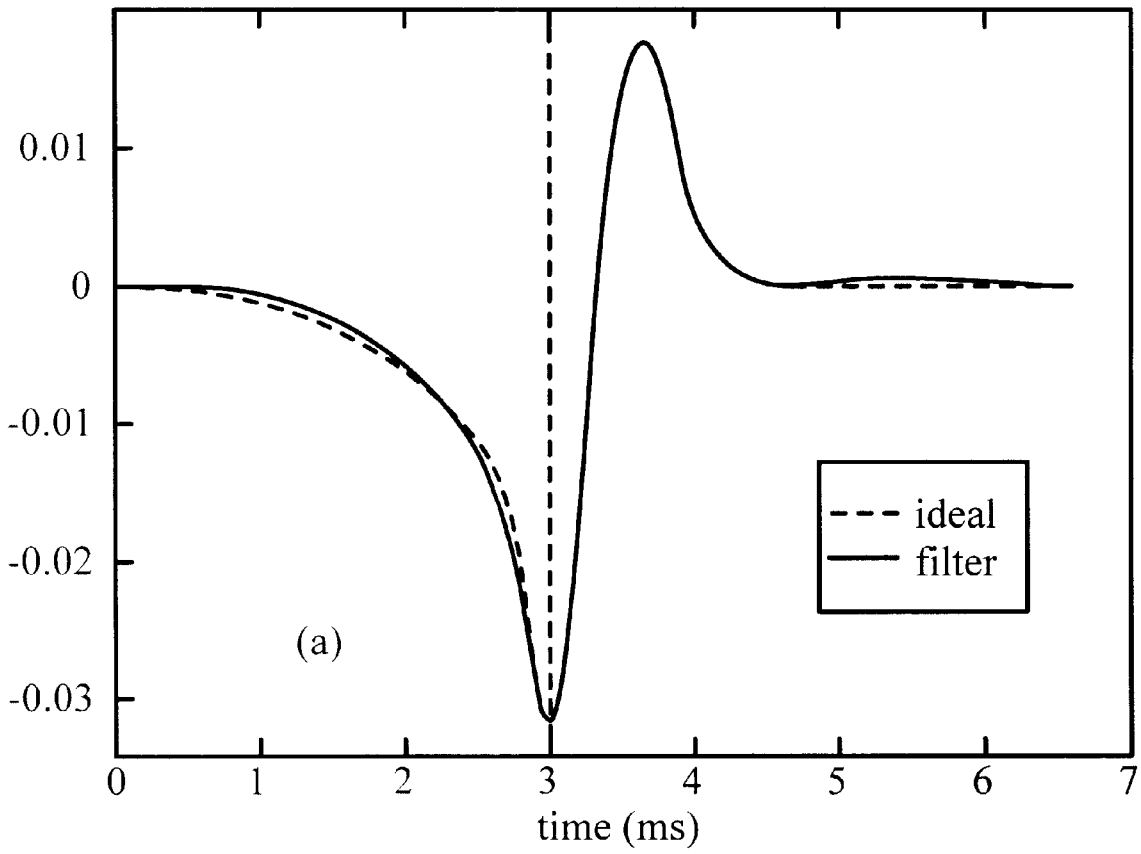
FIGS. 5A, 5B, and 5C are graphs showing the response of a theoretical Bessel horn and its digital filter approximation.
Figure 5B:
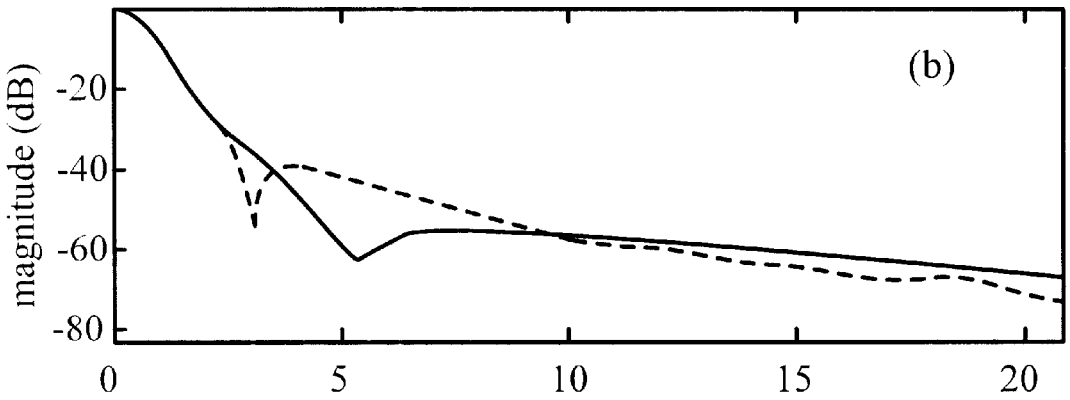
Figure 5C:
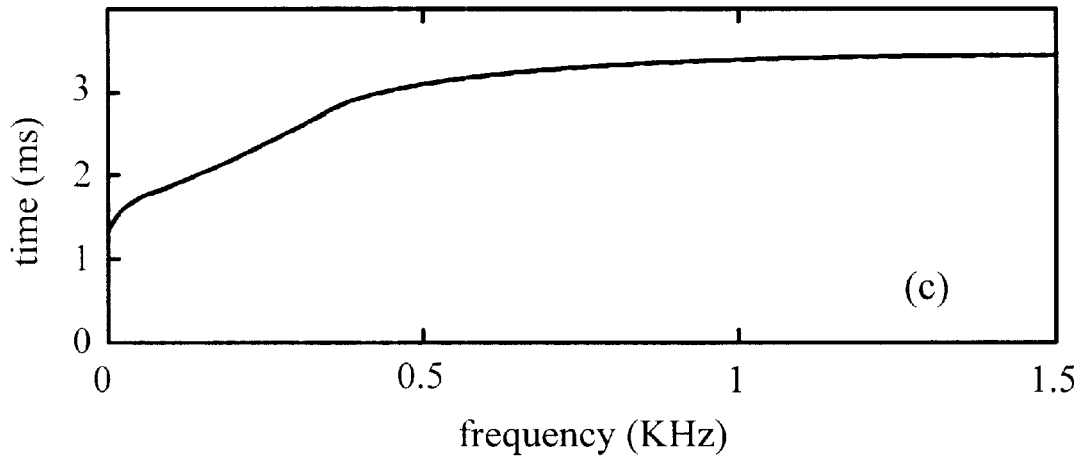

In FIGS. 5A, 5B, and 5C, the TIIR horn filter structure (using a $3^{rd}$-order IIR tail filter approximation) is compared with the theoretical response. The phase delay (directly proportional to the "effective length" of the bell for standing waves), has a particularly good fit, which is important for accurate musical resonance frequencies in a brass instrument.

Appendix B provides a software implementation of the Bessel horn model. Appendix E further provides listings of all modified STK utilities.

Bell Model Based on Pulse Reflectometry Measurements

Acoustic pulse reflectometry techniques can be applied to obtain empirically the impulse response of a trumpet (without mouthpiece). In the present example, a piecewise cylindrical section model of the bore profile was reconstructed using an inverse-scattering method, taking into account the viscothermal losses, and representing the open-end reflection as a continuation of the cylindrical section model having an equivalent reflectance.

The piecewise cylindrical model corresponds well to the physical bore profiles for non-flaring tube-segments, thus giving a good physical model up to the bell. The remaining cylindrical sections do not provide valid geometrical information, but they retain all relevant acoustical information for characterizing the bell reflectance, including the complex effects of higher order transverse modes and radiation impedance. The impulse response of this non-physical section of the model, corresponding to the bell and radiation load, is defined here as the empirical estimate of the isolated bell reflectance.

Figure 6:
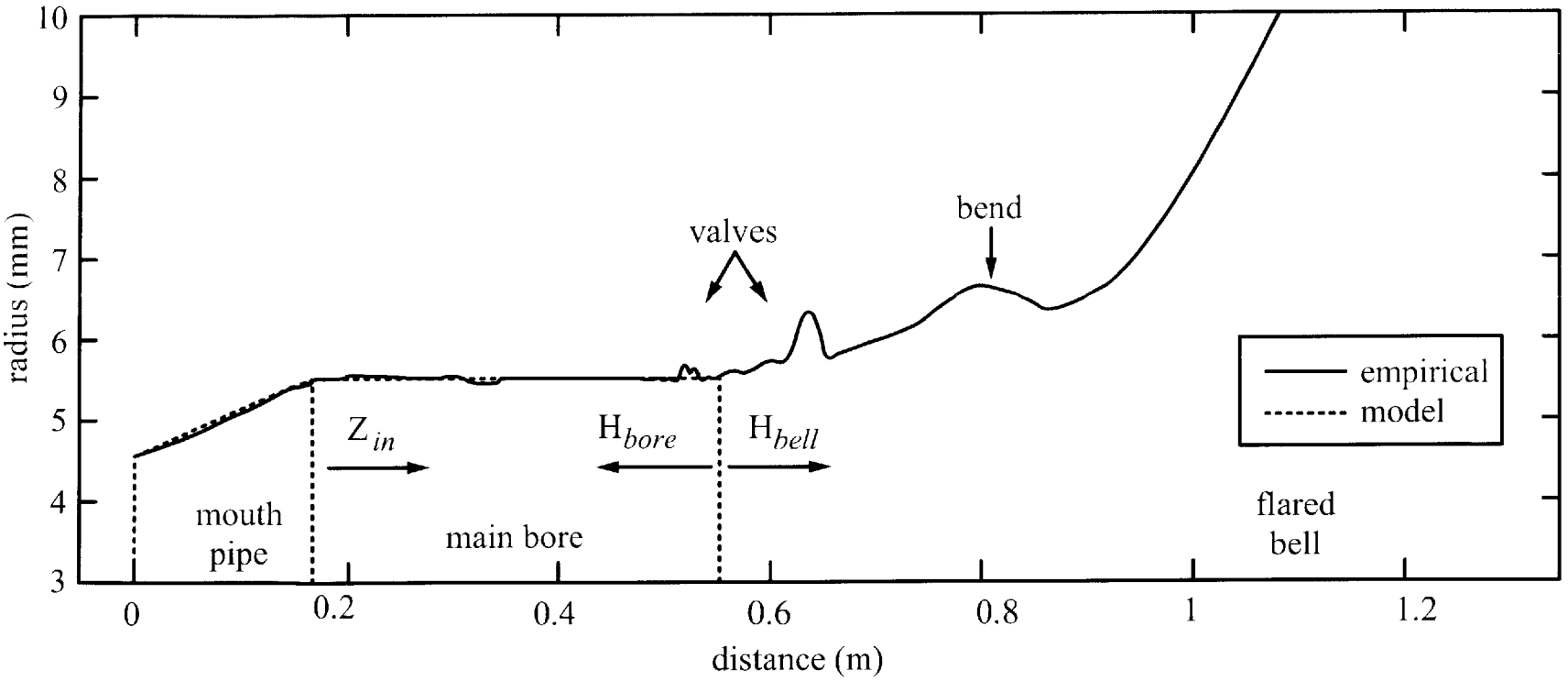
FIG. 6 is a graph showing the outline of a piecewise cylindrical acoustic tube model constructed from pulse reflectometry data applied to a real trumpet.
Figure 7A:
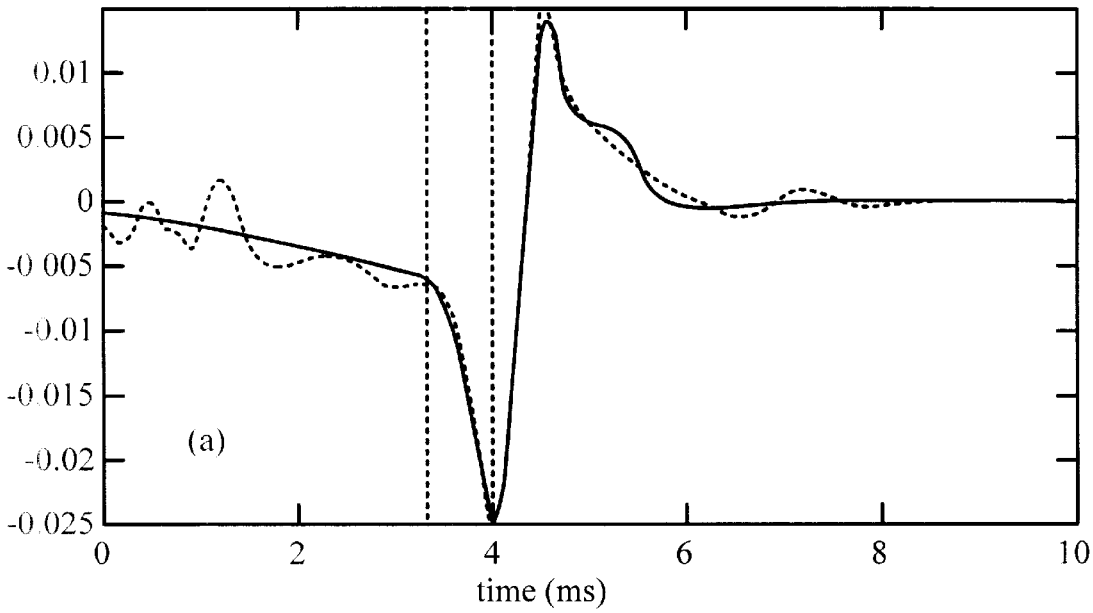
FIGS. 7A and 7B are graphs showing the results of approximating the last section of a trumpet bore using the techniques of the present invention.
Figure 7B:
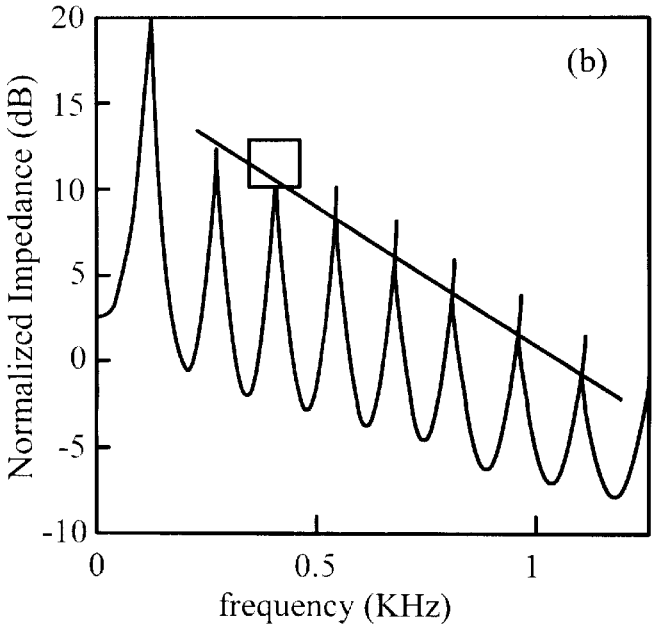

The main bore of a trumpet is essentially cylindrical, with an initial taper widening (mouthpipe) (see FIG. 6). Thus, an accurate digital waveguide model of the trumpet can be derived by approximating the bore profile data with a cylindrical bore, plus a conical section to model the mouthpipe, and modeling the remaining part of the reconstruction as the bell reflectance $H_{bell}(\omega)$. The complexity of the model is further reduced by lumping the viscothermal losses of the main bore with the bell reflectance filter, yielding the "round-trip filter" $H_{rt}(\omega)$:

$$H_{rt}(\omega) = \frac{H_{bore}(\omega)}{H'_{bore}(\omega)} * H_{bell}(\omega) \tag{2}$$

where $H_{bore}(\omega)$ represents the response "seen" from the bell (see FIG. 6) while assuming an ideal closed end at the junction between the mouthpipe and the main bore, and $H'_{bore}(\omega)$ is the theoretical value of $H_{bore}(\omega)$ assuming no losses. The inverse Fourier transform $h_{rt}(t)$ differs from the theoretical Bessel horn response primarily in its two-stage build-up towards the primary reflection peak (see FIGS. 5 and 7). This characteristic was observed for a variety of brass instruments. By adding another offset-exponential TIIR section (Eq. (1)) to the basic horn filter structure in FIG. 4, the filter design methodology is sufficiently flexible to cover the two-stage build-up. The resulting impulse response and corresponding input impedance curve $Z_{in}(\omega)$ ("seen" from the start of the main bore) are depicted in FIGS. 7A and 7B. The small amplitude deviations are mainly due to the fact that the TIIR approximation of the initial slow rise is insensitive to reflections caused by bore profile dents. Such deviations may be compensated within a mouthpiece model. Note that the resonance frequencies controlled by the phase delay of $h_{rt}(t)$ are accurately modeled.

Appendix C provides a software implementation of the empirically derived horn model. Appendix E further provides listings of modified STK utilities.

Piecewise Conical Bore Modeling

Figure 8A:
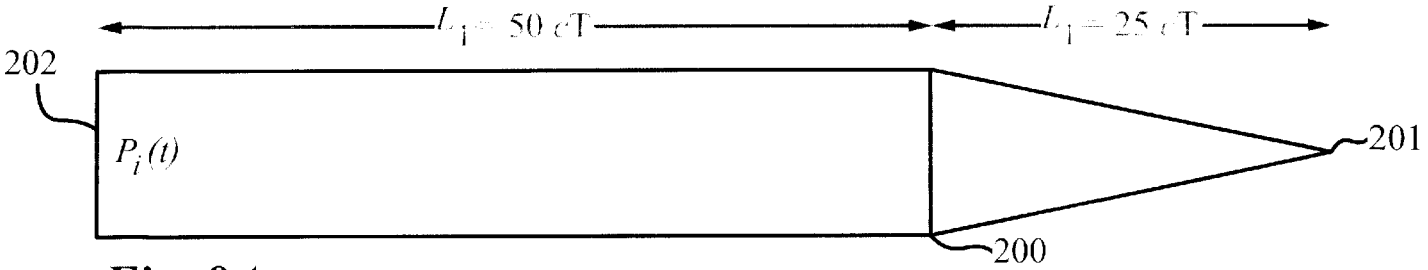
FIGS. 8A, 8B, and 8C show a cylindrical acoustic tube with conical cap, and its corresponding computational model.
Figure 8B:
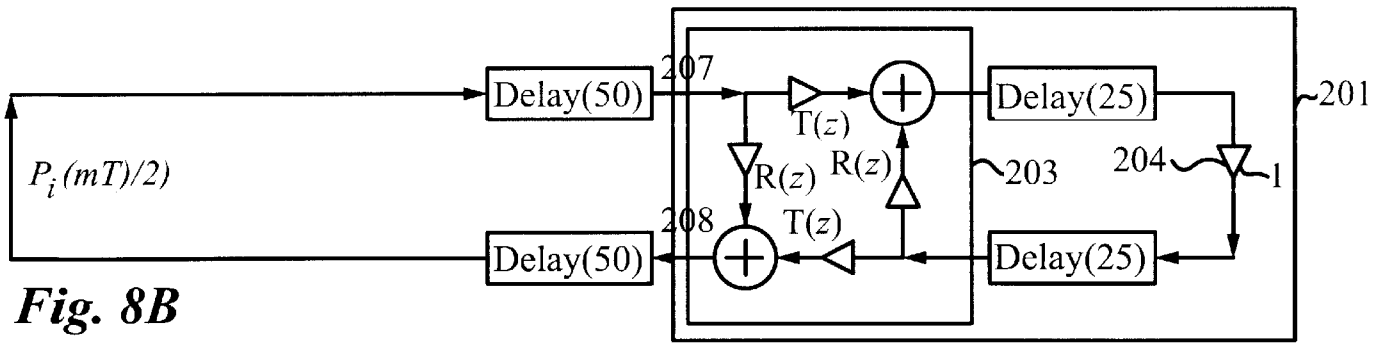
Figure 8C:
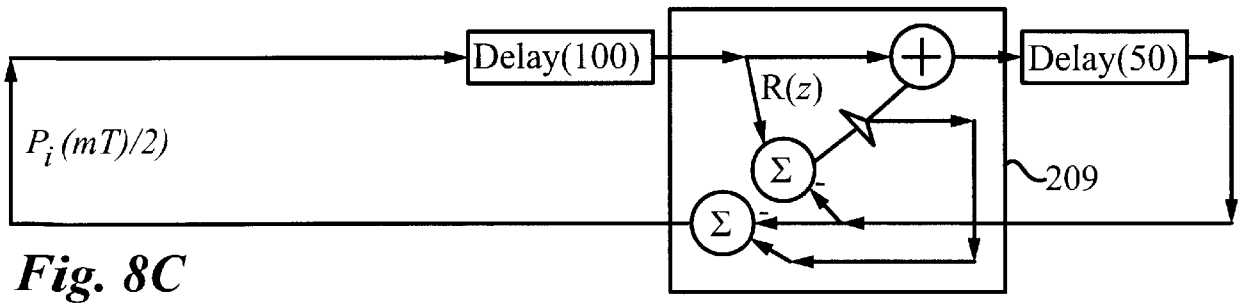

FIGS. 8A, 8B, and 8C illustrate a digital waveguide model of a cylindrical tube adjoined to a converging conical tube. It is well known that the wave impedance at frequency $\omega$ rad/sec in an anechoic converging cone is given by $$Z_\xi(j\omega) = \frac{\rho c}{S(\xi)} \frac{j\omega}{j\omega - c/\xi}$$

where $\xi$ is the distance to the apex of the cone, $S(\xi)$ is the cross-sectional area, and $\rho c$ is the wave impedance in open air. (In FIGS. 8A, 8B, and 8C, $\xi = L_2 = 25cT = 25$ spatial samples.) A cylindrical tube is the special case $\xi = \infty$, giving $R_\infty(j\omega) = \rho c/S$, independent of position in the tube. Under normal physical assumptions at the cylinder-cone junction 200, and assuming no reflected waves from either the conical tip 201 or the cylinder cap 202, the junction reflection transfer function (reflectance) seen from the cylinder looking into the cone is derived to be $$R_J(s) = -\frac{c/\xi}{c/\xi - 2s} = -\frac{1}{1 - 50sT}$$

(where s is the Laplace transform variable which generalizes $s = j\omega$. Similarly, the junction transmission transfer function (transmittance) to the right is given by $$T_J(s) = 1 + R_J(s) = -\frac{2s}{c/\xi - 2s} = -\frac{50sT}{1 - 50sT}.$$

The reflectance and transmittance looking into the junction from the right are the same when there is no wavefront area discontinuity at the junction. Both $R_J(s)$ and $T_J(s)$ are first-order transfer functions: They each have a single real pole at $s = c/2\xi$. Since this pole is in the right-half plane, it corresponds to an unstable one-pole filter.

To take these reflectances and transmittances to the digital domain, we may choose the well known bilinear transformation:

$$sT = 2\frac{1 - z^{-1}}{1 + z^{-1}} \tag{3}$$

where T is the desired digital sampling interval. Accordingly, we define the digital reflectance and transmittance filters R(z) and T(z) by $$R(z) = R_J\left(\frac{2}{T} \cdot \frac{1 - z^{-1}}{1 + z^{-1}}\right) = \left(\frac{cT}{4\xi - cT}\right) \frac{1 + z^{-1}}{1 - \left(\frac{4\xi + cT}{4\xi - cT}\right) z^{-1}}$$
$$= \frac{1}{99} \cdot \frac{1 + z^{-1}}{1 - \frac{101}{99} z^{-1}}$$

$$T(z) = T_J\left(\frac{2}{T} \cdot \frac{1 - z^{-1}}{1 + z^{-1}}\right) = \left(\frac{4\xi}{4\xi - cT}\right) \frac{1 - z^{-1}}{1 - \left(\frac{4\xi + cT}{4\xi - cT}\right) z^{-1}}$$
$$= \frac{100}{99} \cdot \frac{1 - z^{-1}}{1 - \frac{101}{99} z^{-1}} = 1 + R(z)$$

Since the bilinear transformation preserves filter order, the corresponding digital filters are also first order, having a single real pole at $(4\xi + cT)/(4\xi - cT) = 101/99$. Since the bilinear transform preserves stability, we have that R(z) and T(z) are also unstable one-pole digital filters.

An alternative order-preserving conversion from continuous-time to discrete-time filtering is the impulse-invariant transformation:

$$R_{ii}(z) = \frac{1}{1 - e^{cT/2\xi} z^{-1}}$$

The impulse-invariant method preserves the impulse response exactly at the sampling instants, which is ideal for matching impulse responses published in the musical acoustics literature. On the other hand, the impulse invariant method has the disadvantage of aliasing, due to sampling, which distorts both the amplitude and phase response at all frequencies. In general, the high-frequency gain tends to rise due to aliasing. The bilinear transformation does not alias, but it warps the frequency axis according to Eq. (3) which has the effect of artificially lowering the gain at high frequencies (since the true response generally decreases in magnitude as frequency increases). On the other hand, the entire continuous-time amplitude response is exactly preserved over the warped frequency axis. Phase is similarly preserved exactly over the warped frequency axis by the bilinear transform. Both methods are equivalent in the limit as the sampling rate approaches infinity (or as frequency approaches zero).

The resulting scattering junction 203 for pressure waves is depicted in FIG. 8B. A closed conical tip reflects like an ideal open-end cylindrical tube-hence the negation 204 at the far right. We also assume no simulation outputs are needed from the within the conical cap so that the $1/\xi$ scaling normally needed for spherical waves can be omitted.

Figure 9B:
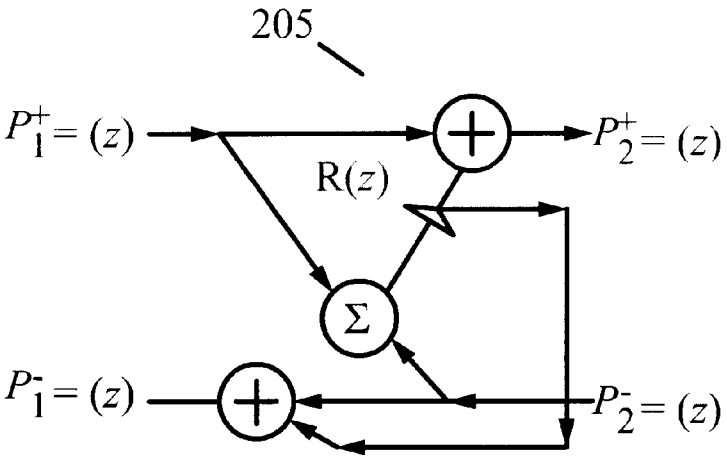
FIGS. 9A and 9B show two equivalent forms of a scattering junction between two conical bore sections.
Figure 9A:
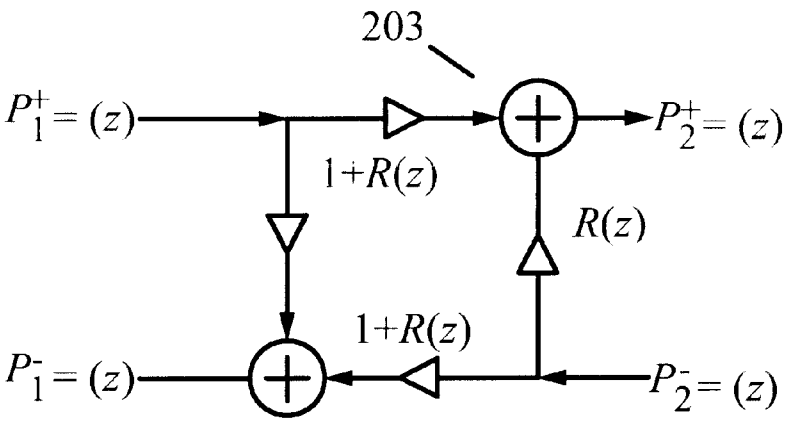

FIG. 9A shows just the scattering junction 203 from FIG. 8B. Algebraically, the scattering relations for this type of junction are $$P_2^+(z)=[1+R(z)]P_1^+(z)+R(z)P_2^-(z) = P_1^+(z)+R(z)[P_1^+(z)+P_2^-(z)]$$

$$P_1^-(z)=R(z)P_1^+(z)+[1+R(z)]P_2^-(z) = P_2^-(z)+R(z)[P_1^+(z)+P_2^-(z)]$$

The result of the rightmost factorization is shown as scattering junction 205 in FIG. 9B. We see that the computations can be organized in "one-filter form." Finally, incorporating the sign inversion 204 into the junction gives the one-filter form 209 shown in FIG. 8C.

Since the filter R(z) is unstable, we must periodically clear its state in order to avoid indefinite build-up of round-off error. The overall system must be stable when it consists of only passive physical elements, as we have here. The rising exponentials generated by R(z) and T(z) must always be ultimately canceled by reflections from the conical tip. Thus, the overall conical section itself behaves like a TIIR filter. However, the conical cap is not exactly TIIR because it is not exactly FIR. In principle, "echoes" go on indefinitely between conical junctions (such as between the cylinder-cone junction and the conical tip in our simple example of FIGS. 8A, 8B, and 8C). It can be shown that the unstable poles are always canceled in the context of the complete bore. In practical cases, the overall decay is simply very fast.

To apply TIIR techniques to conical junction modeling, it is necessary to determine the "audible length" of the impulse response after which it can be replaced by zero. Typically, bores used in musical instruments have impulse responses which are quite short, as can be tested informally by slapping the small end of the bore with one's hand and listening to the very short "ring" afterwards. A commonly used measure of effective decay time in room acoustics is $t_{60}$ which is the time to decay by 60 dB. The $t_{60}$ of the bore (or bore section) can be taken as the minimum "warm-up time" for a fresh instance of the TIIR model section. While $t_{60}$ has no effect on the filter structures themselves, it does place demands upon the dynamic range (computational word-length); the round-off noise in all unstable filter elements must remain inaudible for $t_{60}$ seconds. The cost of the implementation can be decreased by replacing $t_{60}$ by $t_{40}$, with an associated reduction in signal to noise ratio. Similarly, a very high quality implementation might choose to use $t_{100}$, etc.

Referring again to the simple example of FIGS. 8A, 8B, and 8C, the unstable conical cap model 206 may be switched with an alternate instance of itself and reset as often as every $t_{60}/T$ samples.

In summary, all model components containing either rising or constant filter impulse responses may be switched out and cleared periodically. These resets can occur as often as every $t_{60}$ seconds, where $t_{60}$ is the time for the external response of the model component to decay by 60 dB. In FIGS. 8A, 8B, and 8C, this is the time for the signal 208 to decay 60 dB below its maximum value in response to an impulse applied via signal 207. Other components need not be switched and reset, since their internal states are strictly stable and decay to zero in the absence of a driving input.

Appendix D provides a programming example for the implementation of the above piecewise conical bore model. Appendix E further provide listings of the modified STK utilities.

We have presented a computationally efficient modeling framework applicable to piecewise conical bores and flaring horns. The models use tail-canceling IIR filters to implement finite-duration exponential, constant, or polynomial impulse responses, with periodic replacement of unstable filter components used to avoid indefinite build-up of round-off errors.

The piecewise conical bore model implements a change in conical taper angle using a single one-pole filter, and this filter is unstable when the taper change is convergent, requiring periodic resets applied to the smallest enclosing stable model component. The resets should be spaced by at least the audible length of the impulse-response of the enclosing stable model component, and by more if there is available dynamic range in the number format used.

The horn model utilized a sequence of offset-exponential segments followed by a more conventional filter for the final "tail" in the measured response.

Compared with previous practical approaches to modeling these musical acoustic elements computationally, the present invention offers compelling advantages.

REFERENCES CITED

1 N. Amir, G. Rosenhouse, and U. Shimony, "Discrete model for tubular acoustic systems with varying cross section—the direct and inverse problems. part 1: Theory," *ACTA Acustica,* vol. 81, pp. 450–462, 1995.

2 R. D. Ayers, L. J. Eliason, and D. Mahgerefteh, "The conical bore in musical acoustics," *American Journal of Physics,* vol. 53, pp. 528–537, June 1985.

3 A. H. Benade and E. V. Jansson, "On plane and spherical waves in horns with nonuniform flare. I. theory of radiation, resonance frequencies, and mode conversion," *Acustica,* vol. 31, no. 2, pp. 80–98, 1974.

4 P. R. Cook, "Synthesis toolkit in C++, version 1.0," in *SIGGRAPH Proceedings, Assoc. Comp. Mach.,* May 1996. (see http://www.cs.princeton.edu/~prc/NewWork.html for a copy of this paper and the software.)

5 J. Gilbert, J. Kergomard, and J. D. Polack, "On the reflection functions associated with discontinuities in conical bores," *J. Acoustical Soc. of America,* vol. 87, pp. 1773–1780, April 1990.

6 J. D. Markel and A. H. Gray, *Linear Prediction of Speech.* New York: Springer Verlag, 1976.

7 J. Martinez and J. Agullo, "Conical bores. part I: Reflection functions associated with discontinuities," *J. Acoustical Soc. of America,* vol. 84, pp. 1613–1619, November 1988.

8 T. W. Parks and C. S. Burrus, *Digital Filter Design.* New York: John Wiley and Sons, Inc., June 1987.

9 G. P. Scavone, *An Acoustic Analysis of Single-Reed Woodwind Instruments with an Emphasis on Design and Performance Issues and Digital Waveguide Modeling Techniques.* PhD thesis, CCRMA, Music Dept., Stanford University, March 1997. (available as CCRMA Technical Report No. STAN-M-100 or from ftp://ccrma-ftp.stanford.edu/pub/Publications/Theses/GaryScavoneThesis/)

10 D. B. Sharp, *Acoustic Pulse Reflectometry for the Measurement of Musical Wind Instruments.* PhD thesis, Dept. of Physics and Astronomy, University of Edinburgh, 1996.

11 J. O. Smith, "Music applications of digital waveguides," Tech. Rep. STAN-M-39, CCRMA, Music Dept., Stanford University, 1987. (a compendium containing four related papers and presentation overheads on digital waveguide reverberation, synthesis, and filtering. CCRMA technical reports can be ordered by calling (415)723-4971 or by sending an email request to info@ccrma.stanford.edu.)

12 J. O. Smith, "Waveguide simulation of non-cylindrical acoustic tubes," in *Proc.* 1991 *Int. Computer Music Conf.,* Montreal, pp. 304–307, Computer Music Association, 1991.

13 J. O. Smith, "Physical modeling using digital waveguides," *Computer Music J.,* vol. 16, pp. 74–91, Winter 1992. special issue: Physical Modeling of Musical Instruments, Part I. Available online at http://www-ccrma.stanford.edu/~jos/.

14 J. O. Smith, "Physical modeling synthesis update," *Computer Music J.,* vol. 20, pp. 44–56, Summer 1996. available online at http://www-ccrma.stanford.edu/~jos/.

15 J. O. Smith and G. Scavone, "The one-filter Keefe clarinet tonehole," in *Proc. IEEE Workshop on Appl. Signal Processing to Audio and Acoustics,* New Paltz, N.Y., (New York), IEEE Press, October 1997.

16 V. Välimäki, *Discrete-Time Modeling of Acoustic Tubes Using Fractional Delay Filters.* PhD thesis, Report no. 37, Helsinki University of Technology, Faculty of Elec. Eng., Lab. of Acoustic and Audio Signal Processing, Espoo, Finland, December 1995.

17 V. Välimäki and M. Karjalainen, "Digital waveguide modeling of wind instrument bores constructed of truncated cones," in *Proc.* 1994 *Int. Computer Music Conf.,* Århus, pp. 423–430, Computer Music Association, 1994.

18 M. van Walstijn and V. Välimäki, "Digital waveguide modeling of flared acoustical tubes," in *Proc.* 1997 *Int. Computer Music Conf.,* Greece, (Thessaloniki, Greece), pp. 196–199, Computer Music Association, 1997.

19 M. van Walstijn and J. O. Smith III, "Use of Truncated Infinite Impulse Response {TIIR} Filters in Implementing Efficient Digital Waveguide Models of Flared Horns and Piecewise Conical Bores with Unstable One-Pole Filter Elements," in *Proc., Int. Symp. Musical Acoustics* (*ISMA*-98), (Leavenworth, Wash.), pp. 309–314, Acoustical Society of America, Jun. 28, 1998.

20 A. Wang and J. O. Smith, "On fast FIR filters implemented as tail-canceling IIR filters," *IEEE Trans. Signal Processing,* vol. 45, pp. 1415–1427, June 1997.

Referenced Patents

U.S. Pat. No. 5,212,334 issued May 18, 1993 to Julius O. Smith, III.

U.S. Pat. No. 5,448,010 issued Sep. 5, 1995 to Julius O. Smith, III.

APPENDIX A

ONE-POLE TIIR FILTER IMPLEMENTATIONS IN C++

These programming examples use modified modules from the Synthesis Tool Kit (STK) by Perry Cook. Program source for these modified utilities are given in Appendix D. Source for the unmodified utilities may be obtained from http://www-ccrma.stanford.edu/. The heart of each C++ module is its "tick" method in which the basic unction of the module is carried out. The most basic TIIR filter appears first below (tiir1.h and tiir1.cpp). It is based on a stable one-pole filter without resets. Next, the unstable case (generally requiring periodic resets) is given in tiir1r.h and tiir1r.cpp (the trailing 'r' meaning "with resets").

Program for One-Pole-Based TIIR Filter Without Resets

```
/* ---------------------------tiir1.h---------------------------- */
/*
* tiir1.h - Truncated IIR (TIIR) one-pole digital filter
* Julius Smith, March 1998
*
* Implements a digital filter with a truncated exponential impulse response.
* Intended for stable truncated one-poles (decreasing exponential impulse response).
* For the unstable case (increasing exponential or constant), use tiir1r instead.
*
* Parameters are pole location and truncation delay.
*/
#include "onepole.h"
#include "dlinen.h"
class TIIR1 : public Filter
{
protected:
    long length;
    MY_FLOAT pole;
    OnePole *filter1;
    OnePole *filter2;
    DLineN *delayLine;
    int delayLineExternal;
public:
    TIIR1 (void);
    TIIR1(long len, MY_FLOAT thePole);
```

-continued

APPENDIX A

ONE-POLE TIIR FILTER IMPLEMENTATIONS IN C++

```
    ~TIIR1 ();
    void setPole(MY_FLOAT thePole);
    void setDelayLine(DLineN *theDL);
    void clearState ();
    void clear();
    MY_FLOAT delayLastOut(void);
    virtual MY_FLOAT tick(MY_FLOAT insamp);
    MY_FLOAT tickFirstFilter(MY_FLOAT insamp);
};
/* ----------------------------tiir1.cpp------------- */
#include "tiir1.h"
TIIR1 :: TIIR1(void) : Filter()
{
    filter1 = new OnePole();
    filter2 = new OnePole();
    lastOutput = 0;
    delayLineExternal = 0;
}
TIIR1 :: TIIR1(long len, MY_FLOAT thePole)
{
    length = len;
    delayLine = new DLineN(len+1);
    delayLine->setDelay(len);
    filter1 = new OnePole();
    filter2 = new OnePole();
    this->setPole (thePole);
    lastOutput = 0.0;
    delayLineExternal = 0;
}
TIIR1 :: ~TIIR1()
{
    if (!delayLineExternal)
        delete delayLine;
    delete filter1;
    delete filter2;
}
void TIIR1 :: clearState(void)
{
    filter1->clear()
    filter2->clear()
        lastOutput = 0;
}
void TIIR1 :: clear(void)
{
    this->clearState ();
    if (delayLine && !delayLineExternal)
    delayLine->clear();
    }
    void TIIR1 :: setPole(MY_FLOAT thePole)
    {
    pole = thePole;
    filter1->setDen(-pole);
    filter2->setDen(-pole);
    filter1->setNum(1);
    filter2->setNum(pow(pole,length));
    //    filter1->setGain(1/(1-pole)); // fails when pole=1
    //    filter2->setGain(pow(pole,length)/(1-pole));
    if (length == 0) {
        fprintf (stderr,
            "*** tiir1.cpp: Must set delay line hefore setting pole ");
    }
}
void TIIR1 :: setDelayLine(DLineN *theDL)
{
    delayLine = theDL;
    delayLineExternal = 1;
    length = (int) delayLine->delay();
}
MY_FLOAT TIIR1 :: tick(MY_FLOAT insamp)
{
    lastOutput = filter1->tick(insamp) - filter2->tick(delayLine->tick(insamp));
    return lastOutput;
}
MY_FLOAT TIIR1 :: tickFirstFilter(MY_FLOAT insamp)
{
```

-continued

APPENDIX A

ONE-POLE TIIR FILTER IMPLEMENTATIONS IN C++

```
    lastOutput = filter1->tick(insamp);
    return lastOutput;
}
MY_FLOAT TIIR1 :: delayLastOut(void)
{
    return delayLine->lastOut ();
}
```

Program for One-Pole-Based TIIR Filter With Resets

```
/* ----------tiir1r.h---------- */
/*
* tiir1r.h - Truncated IIR (TIIR) one-pole digital filter with Reset
* Julius Smith, March 1998
*
* Implements a digital filter with a truncated exponential impulse response.
* Intended for unstable truncated one-poles (increasing exponential or constant).
* For the stable case (decreasing exponential), tiir1 can be used
* to save computation.
*
* Parameters are pole location and truncation delay.
*/
#include "tiir1.h"
#include "dlinen.h"
class TIIR1R : public Filter
{
protected:
    long length;
        long resetInterval;
    MY_FLOAT pole;
    TIIR1 *filter1;
    TIIR1 *filter2;
    TIIR1 *currentFilter;
    TIIR1 *otherFilter;
    DLineN *delayLine;
    int sampCounter;
    int resetState;
public:
    TIIR1R(long len);
    TIIR1R(long theLength, long theResetInterval, MY_FLOAT thePole);
    ~TIIR1R();
    void setPole(MY_FLOAT thePole);
    void clearState ();
    MY_FLOAT delayLastOut(void);
    virtual MY_FLOAT tick(MY_FLOAT insamp);
};
/* ----------tiir1r.cpp---------- */
*include "tiir1r.h"
TIIR1R :: TIIR1R(long len, long rsi, MY_FLOAT thePole) Filter()
{
    length = len;
    if (rsi > len) {
      resetInterval = rsi;
    } else {
      fprintf (stderr,
            "*** TIIR1R: Reset interval must be greater than delay length "
            " Setting reset interval to delay length + 1 = %d ", length+1);
      resetInterval = length+1;
    }
    pole = thePole;
/* The SHARED_DELAY compile-time switch is used for debugging.
    It is normally set to 1, but setting it to 0 gives a nice check
    for comparing the results. */
#define SHARED_DELAY 1
#if SHARED_DELAY
    delayLine = new DLineN(len+1);
    delayLine->setDelay(len);
    filter1 = new TIIR1();
    filter1->setDelayLine (delayLine);
    filter2 = new TIIR1();
    filter2->setDelayLine(delayLine);
    filter1->setPole(pole)
    filter2->setPole(pole)
#else
    filter1 = new TIIR1(len,pole);
    filter2 = new TIIR1(len,pole);
```

-continued

APPENDIX A

ONE-POLE TIIR FILTER IMPLEMENTATIONS IN C++

```
#endif
    sampCounter = resetInterval;
    currentFilter = filter1;
    otherFilter = filter2;
    resetState = 1;
    lastOutput = 0;
}
TIIR1R :: ~TIIR1R()
{
#if SHARED_DELAY
    delete delayLine;
#endif
    delete filter1;
    delete filter2;
}
void TIIR1R :: setPole(MY_FLOAT thePole)
{
    pole = thePole;
    filter1->setPole(thePole);
    filter2->setPole(thePole);
}
MY_FLOAT TIIR1R :: tick(MY_FLOAT insamp)
{
    lastOutput = currentFilter->tick(insamp);
#if SHARED_DELAY
    if (sampCounter <= length)
    otherFilter->tickFirstFilter(insamp); /* warm it up */
#else
    otherFilter->tick(insamp);
#endif
    sampCounter -= 1;
    if (sampCounter == 0) { /* reset time */
        sampCounter = resetInterval;
        if (resetState) {
            currentFilter = filter2;
            otherFilter = filter1;
        } else {
            currentFilter = filter1;
            otherFilter = filter2;
        }
        otherFilter->clear();
        resetState = 1 - resetState; // 0 or 1
    }
        return lastOutput;
}
void TIIR1R :: clearState(void)
{
    filter1->clearState();
    filter2->clearState();
    lastOutput = 0;
}
MY_FLOAT TIIR1R :: delayLastOut(void)
{
#if SHARED_DELAY
    return delayLine->lastout();
#else
    fprintf (stderr,
        "TIIR1R: DON'T CALL delayLastOut --- DELAY LINE NOT SHARED ");
    return currentFilter->delayLine->lastOut();
#endif
}
```

-continued

APPENDIX B

PROGRAM FOR THE TIIR BESSEL HORN MODEL

```
/* ----------------------------tbessel3.cpp------------------------- */
/*
* Implementation of the theoretical Bessel horn
* response using TIIR1R + Biquad
* by Julius Smith & Maarten van Walstijn, 1998.
* Fs = 44100 in this example.
```

-continued

APPENDIX B

PROGRAM FOR THE TIIR BESSEL HORN MODEL

```
*/
#include "object.h"
#include <std1ib.h>
#include <ctype.h>
#include "allwvout.h"
#include "biquad.h"
#include "dilnen.h"
#include "tiir1r.h"
/**********     Test Main     ******************/
void main(int argc,char *argv[])
{
    long i;
    long nsamps = 16384;
    long delayBore = 100;
    SndWvOut *output;
    short anechoic = 0; /* set 0 for audible impulse response */
MY_FLOAT insamp;
MY_FLOAT outsamp;
TIIR1R *exp1;
TIIR1R *offset1;
BiQuad *tail;
MY_FLOAT explOut;
MY_FLOAT delay1Out;
MY_FLOAT offset1Out;
MY_FLOAT BiQuadOut;
MY_FLOAT boreOut;
MY_FLOAT boreIn;
MY_FLOAT bellOut;
MY_FLOAT BiQuadGain = -0.031502847073158;
MY_FLOAT Bcoef[2] = {-0.767558892726732, -0.266006570992809};
MY_FLOAT Acoef[2] = {1.899509324075816, -0.907062115228098 };
MY_FLOAT exp1Gain = -0.000920570756035;
MY_FLOAT pole1 = 1.027314036038760;
long delay1 = 134;
MY_FLOAT offsetGain = 0.000920724423376;
DLineN *delayLine = new DLineN(delayBore+1);
delayLine->setDelay(delayBore);
```

-continued

APPENDIX B

PROGRAM FOR THE TIIR BESSEL HORN MODEL

```
delayLine->clear();
output = new SndWvOut("test.snd");
expl = new TIIR1R(delay1,delay1*4,pole1) ; /* 2nd arg = reset interval */
offset1 = new TIIR1R(delay1,delay1*4,1.0);
exp1->clearState();
offset1->clearState();
    tail = new BiQuad;
    tail->clear();
    tail->setGain(BiQuadGain);
    tail->setPoleCoeffs (Acoef);
    tail->setZeroCoeffs (Bcoef);
    bellOut = 0.0;
    for (i=0; i<nsamps; i++)
    {
        insamp = 0.0;
        if (i==0)
            insamp = 1.0; /* initial impulse */
        if (anechoic)
            boreIn = insamp;
        else
            boreIn = insamp + bellOut;
        boreOut = delayLine->tick(boreIn);
        exp1Out = exp1Gain*exp1->tick(boreOut);
        offset1Out = offsetGain*offset1->tick(boreOut);
        delay1Out = exp1->delayLastOut(); // Output to next stage
        BiQuadOut = tail->tick(delay1Out);
        bellOut = offset1Out + exp1Out + BiQuadOut;
        outsamp = bellOut;
        if (fabs(outsamp)>1.0) {
            outsamp = (outsamp > 0 ? 1.0 : -1.0);
        }
        output->tick (outsamp);
    }
    exit(0);
}
```

APPENDIX C
PROGRAM FOR THE TIIR EMPIRICAL HORN MODEL

```
/* ---------------------------tempiric.cpp---------------------------*/
/*
* Implementation of the empirically derived
* trumpet bell reflectance using 2 TIIR1R's + 2 cascaded Biquads.
* by Julius Smith & Maarten van Walstijn, 1998.
* Fs = 44100 in this example.
*/
#include "object.h"
#include <stdlib.h>
#include <ctype.h>
#include "allwvout.h"
#include "biquad.h"
#include "dlinen.h"
#include "tiit1r.h"
/************     Test Main     ******************/
void main(int argc,char *argv[])
{
    long i;
    long nsamps = 16384;
    long delayBore = 106;
    SndWvOut *output;
    short anechoic = 0;                /* set 0 for audible impulse response */
    long RF = 4;                       /* Reset Factor - multiplies delay length */
    MY_FLOAT insamp;
    MY_FLOAT outsamp;
    MY_FLOAT scaler = 1.0;
TIIR1R *exp1;
TIIR1R *offset1;
TIIR1R *exp2;
TIIR1R *offset2;
```

-continued

APPENDIX C
PROGRAM FOR THE TIIR EMPIRICAL HORN MODEL

```
BiQuad *biq1;
BiQuad *biq2;
MY_FLOAT exp1Out;
MY_FLOAT exp2Out;
MY_FLOAT delay1Out;
MY_FLOAT delay2Out;
MY_FLOAT offset1Out;
MY_FLOAT offset2Out;
MY_FLOAT BiQuadOut;
MY_FLOAT boreOut;
MY_FLOAT boreIn;
MY_FLOAT bellOut;
MY_FLOAT BiQuadGain = −0.024466076327202;
MY_FLOAT Bcoef1[2] = {−1.734609594400476, 0.780161706396821};
MY_FLOAT Acoef1[2] = {1.870507915450234, −0.901866269882395};
MY_FLOAT Bcoef2[2] = {−1.067949323874650, 0.064316263480290};
MY_FLOAT Acoef2[2] = {1.917496768757269, −0.921092698222418};
MY_FLOAT exp1Gain = −0.004522291811398;
MY_FLOAT pole1 = 1.006757123110431;
MY_FLOAT offset1Gain = 0.003682371931502;
long delay1 = 144;
MY_FLOAT exp2Gain = −0.001214435562564;
MY_FLOAT pole2 = 1.097844218905786;
long delay2 = 29;
MY_FLOAT offset2Gain = −0.006993203542683;
DLineN *delayLine = new DLineN(delayBore+1);
delayLine->setDelay(delayBore)
delayLine->clear ();
output = new SndWvOut ("test.snd");
exp1 = new TIIR1R(delay1,delay1*RF,pole1); /* 2nd arg = reset interval */
exp2 = new TIIR1R(delay2,delay2*RF,pole2);
offset1 = new TIIR1R(delay1,delay1*RF,1.0);
offset2 = new TIIR1R(delay2,delay2*RF,1.0);
exp1->clearState()
offset1->clearState ()
exp2->clearState();
offset2->clearState();
biq1 = new BiQuad;
biq1->clear()
biq1->setGain(1.0)
biq1->setPoleCoeffs(Acoef1);
biq1->setZeroCoeffs(Bcoef1);
biq2 = new BiQuad;
biq2->clear();
biq2->setGain(1.0);
biq2->setPoleCoeffs(Acoef2);
biq2->setZeroCoeffs(Bcoef2);
scaler = 20.0;
bellOut = 0.0;
for (i=0; i<nsamps; i++)
{
    insamp = 0.0;
    if (i==0)
        insamp = 1.0; /* initial impulse */
    if (anechoic)
        boreIn = insamp;
    else
        boreIn = insamp + bellOut;
    boreOut = delayLine->tick(boreIn);
    exp1Out = exp1Gain*exp1->tick(boreOut);
    offset1Out = offset1Gain*offset1->tick(delayOut);
    delay1Out = exp1->delayLastOut(); /* Output to next stage */
    exp2Out = exp2Gain1*exp2->tick(delay1Out);
    offset2Out = offset2Gain*offset2->tick(delay1Out);
    delay2Out = exp2->delayLastOut(); /* Output to next stage */
    BiQuadOut = BiQuadGain*(biq2->tick(biq1->tick(delay2Out)));
    bellOut = (offset1Out + exp1Out + offset2Out + exp2Out + BiQuadOut)
    outsamp = scaler*bellOut;
    if (fabs(outsamp)>1.0) {
    scaler = scaler / fabs(outsamp);
    outsamp = (outsamp > 0 ? 1.0 : −1.0);
    }
    output->tick(outsamp);
}
exit(0);
}
```

APPENDIX D

PROGRAM AND MODULES FOR A PIECEWISE CONICAL BORE MODEL

First we list the main program, followed by two cases of conical cap simulation, first without resets, then with.

Main Program

```
/* tcone9p.cpp - C++ source file, for use with Perry Cook's STK C++ library. */
#include "object.h"
#include "allwvout.h"
#include "dlinen.h
#include "onepole.h"
#include "onezero.h
#include "coner.h"
#include <stdlib.h>
#include <ctype.h>
void main(int argc,char *argv[])
{
	long i;
	long nsamps = 150000;
	long resetInterval = 500; // samples
	long delay1 = 39; // about 300mm at 44.1kHz sampling rate (c=335 m/s)
	long delay2 = 92; // = 700mm / (1000*335 (mm/s) / 44100 (samp/s) )
	MY_FLOAT boreLoss = 1.0; // 1.0 means don't introduce bore loss
	short anechoic = 0; // set to 1 for cap impulse-response test
	short dcBlock = 0; // set to 1 to install dc blocker
	MY_FLOAT impulseAmp = (anechoic? 10.0 : 1.0);
	SndWvOut *output = new SndWvOut("test.snd"); // Output sound file
	SndWvOut *energy = new SndWvOut("energy.snd"); // For checking
	DLineN *delayLine1 = new DLineN(delay1+1);
	delayLine1->setDelay(delay1-1); // remember pipeline delay
	ConeR *cone = new ConeR(resetInterval, delay2);
	OnePole *dcBlock1P;
	OneZero *dcBlock1Z;
	if (dcBlock) {
	dcBlock1P = new OnePole(0.9);
	dcBlock1P->setGain(1.0/(1-0.9));
	dcBlock1Z = new OneZero();
	dcBlock1Z->setCoeff (-1.0);
	dcBlock1Z->setGain(2.0); // to get 1 - 1/z
}
MY_FLOAT cylIn=0,cylOut=0;
for (i=0; i<nsamps; i++)
{
	if (anechoic) cylOut = 0;
	else cylOut = - boreLoss * delayLine1->tick(cylIn); // open end, p waves
	if (i==0) {
		cylOut = impulseAmp; // initial impulse
		printf("Approximate stored energy = %f ",impulseAmp*impulseAmp);
	}
	cylIn = cone->tick(cylOut);
	if (dcBlock)
		cylIn = dcBlock1P->tick(dcBlock1Z->tick(cylIn));
	output->tick(cylIn);
// To see internal traveling waves leaving cone:
//	output->tick(cone->lastBellOut());
	MY_FLOAT e = delayLine1->energy() + cone->energy() + cylIn*cylIn;
	energy->tick(0.1*e);
	if (i % 10000 == 0) {
		printf("%f ",e);
		}
	}
	exit(0);
}
```

Module for Non-Resettable Conical Cap Model

```
/* ------------------------------cone.h------------------------- */
/*
* cone.h - Acoustic cone model
* Julius Smith, April 1998
*
* Implements a digital filter with a one-filter scattering junction
* and delay line.
*
* Parameter = acoustic length in samples
* (time in samples to propagate from apex of cone to other end).
*/
```

-continued

APPENDIX D

PROGRAM AND MODULES FOR A PIECEWISE CONICAL BORE MODEL

```
#include "onepole.h"
#include "onezero.h"
#include "dlinen.h"
class Cone : public Filter
{
protected:
    long length;
    MY_FLOAT pole;
    NY_FLOAT pgain;
    OnePole *onepole;
    OneZero *onezero;
    DLineN *delayLine;
    MY_FLOAT bellIn;
    NY_FLOAT bellOut;
    MY_FLOAT expIn;
    MY_FLOAT expOut;
    MY_FLOAT cylIn;
public:
    Cone(long delay /* total round-trip delay in samples */);
    -Cone ();
    void clear();
    MY_FLOAT energy(void);
    virtual MY_FLOAT tick(MY_FLOAT insamp);
    MY_FLOAT lastBellOut(void)
};
/* ----------cone.cpp---------- */
#include "cone.h"
Cone :: Cone(long delay /* total round-trip delay in samples */)
{
    length = delay;
    double delayTimes2 = 2*delay;
    pole = (delayTimes2+1)/(delayTimes2−1);
    pgain = (1.0/(delayTimes2−1));
    delayLine = new DLineN(delay+1);
    delayLine->setDelay(delay−1); // remember pipeline delay
    onepole = new OnePole(pole);
    onepole->setGain(1/(1-pole));
    onezero = new OneZero();
    onezero->setCoeff(1.0);
    onezero->setGain(2.0*pgain); // 2.0 Necessary to get H(z) = 1 + 1/z
    bellIn = 0;
    bellOut = 0;
}
Cone :: ~Cone()
{
    delete delayLine;
    delete onepole;
    delete onezero;
{
void Cone :: clear(void)
{
    onepole->clear();
    onezero->clear();
    delayLine->clear();
    bellIn = 0;
    lastOutput = 0;
}
MY_FLOAT Cone :: tick(MY_FLOAT cylOut)
{
    bellOut = - delayLine->tick(bellIn);
    expIn = cylOut + bellOut;
    expOut = onepole->tick(onezero->tick(expIn));
    bellIn = cylOut + expOut;
    cylIn = expOut + bellOut;
    lastOutput = cylIn;
    return lastOutput;
}
MY_FLOAT Cone :: energy(void)
{
    /* Ignore sample in onepole filter */
    return delayLine->energy() + bellIn*bellIn;
}
MY_FLOAT Cone :: lastBellOut(void)
{
```

-continued

APPENDIX D

PROGRAM AND MODULES FOR A PIECEWISE CONICAL BORE MODEL

```
        return bellOut;
}
```

Module for Resettable Conical Cap Model

```
/* ----------coner.h---------- */
/*
* coner.h - Switched IIR (SIIR) acoustic cone model
* Julius Smith, April 1998
*
* Implements a digital filter with a one-filter scattering junction
* and delay line, switching them every now and then with a fresh instance.
*
* Parameters are the reset interval in samples and the acoustic length
* in samples (time in samples to propagate from apex of cone to other end).
*
*/
#include "cone.h"
class ConeR : public Filter
{
protected:
    long resetInterval;
    long length;
    Cone *cone1;
    Cone *cone2;
    Cone *currentCone;
    Cone *otherCone;
    int sampCounter;
    int resetState;
public:
    ConeR(long theResetInterval, long roundTripDelay);
    ~ConeR ();
    void clear();
    MY_FLOAT energy(void);
    virtual MY_FLOAT tick(MY_FLOAT insamp);
    MY_FLOAT lastBellOut(void);
};
/* ----------coner.cpp---------- */
#include "coner.h"
ConeR :: ConeR(long theResetInterval, long theLength) : Filter()
{
    resetInterval = theResetInterval;
    length = theLength;
    cone1 = new Cone(length);
    cone2 = new Cone(length);
    sampCounter = resetInterval;
    currentCone = cone1;
    otherCone = cone2;
    resetState = 1;
}
ConeR :: ~ConeR()
{
    delete cone1;
    delete cone2;
}
MY_FLOAT ConeR :: tick(MY_FLOAT insamp)
{
    lastOutput = currentCone->tick(insamp);
    otherCone->tick(insamp); /* should only start warmUpTime before reset */
    sampCounter -= 1;
    if (sampCounter == 0) {
        sampCounter = resetInterval;
        if (resetState) {
            currentCone = cone2;
            otherCone = cone1;
        } else {
            currentCone = cone1;
            otherCone = cone2;
        }
        otherCone->clear ();
    #ifdef DEBUG
        fprintf(stderr, "RESET ");
    #endif
        resetState = 1 - resetState; // 0 or 1
    }
```

-continued

APPENDIX D

PROGRAM AND MODULES FOR A PIECEWISE CONICAL BORE MODEL

```
    return lastOutput;
}
void ConeR :: clear(void)
{
    cone1->clear();
    cone2->clear();
}
MY_FLOAT ConeR :: lastBellOut(void)
{
    return (sampCounter == resetInterval ?
        otherCone->lastBellOut();
        currentCone->lastBellOut());
}
MY_FLOAT ConeR :: energy(void)
{
    return currentCone->energy();
}
```

APPENDIX E

SOURCE LISTINGS FOR ALL MODIFIED STK UTILITIES
These software utilities are modified versions of the ones contained in the Synthesis Tool Kit (STK) as it is presently distributed One-Pole Filter

```
/* ------------------------------ onepole.h ------------------------- */
/*********************************************/
/* One Pole Filter Class,                    */
/* by Perry R. Cook, 1995–96                 */
/* The parameter gain is an additional       */
/* gain parameter applied to the filter      */
/* on top of the normalization that takes    */
/* place automatically. So the net max       */
/* gain through the system equals the        */
/* value of gain. sgain is the combina-      */
/* tion of gain and the normalization        */
/* parameter, so if you set the poleCoeff    */
/* to alpha, sgain is always set to          */
/* gain * (1.0 - fabs(alpha)).               */
/*********************************************/
/* 5/98/jos - added setNum and setDen methods */
#include "filter.h"
class OnePole : public Filter
{
    protected:
        MY_FLOAT poleCoeff;
        MY_FLOAT sgain;
    public:
        OnePole();
        ~OnePole()
        OnePole(MY_FLOAT thePole);
        void clear ();
        void setNum(MY_FLOAT aValue); /* set numerator b0 in b0/(1+a1/z) */
        void setDen(MY_FLOAT aValue); /* set denominator a1 in b0/(1+a1/z) */
        void setPole(MY_FLOAT aValue);
        void setGain(MY_FLOAT aValue); /* peak gain at DC: default = 1.0 */
        MY_FLOAT tick(MY_FLOAT sample);
};
/* ------------------------------ onepole.cpp ------------------------- */
/*********************************************/
/* One Pole Filter Class,                    */
/* by Perry R. Cook, 1995–96                 */
/* The parameter gain is an additional       */
/* gain parameter applied to the filter      */
/* on top of the normalization that takes    */
/* place automatically. So the net max       */
/* gain through the system equals the        */
/* value of gain. sgain is the combina-      */
/* tion of gain and the normalization        */
/* parameter, so if you set the poleCoeff    */
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
/* to alpha, sgain is always set to          */
/* gain * (1.0 - fabs(alpha)).               */
/*****************************************/
/* 5/98/jos - added setNum and setDen methods */
#include "onepole.h"
OnePole :: Onepole() : Filter()
{
    poleCoeff = 0.9;
    gain = 1.0;
    sgain = 0.1;
    outputs = (MY_FLOAT *) malloc (MY_FLOAT_SIZE);
    outputs[0] = 0.0;
    lastOutput = 0.0;
}
OnePole :: OnePole(MY_FLOAT thePole) : Filter()
{
    poleCoeff = thepole;
    gain = 1.0;
    sgain = 1.0 - fabs(thePole);
    outputs = (MY_FLOAT *) malloc(MY_FLOAT_SIZE);
    outputs[0] = 0.0;
    lastOutput = 0.0;
}
Onepole :: ~Onepole()
{
    free(outputs);
}
void OnePole :: clear()
{
    outputs[0] = 0.0;
    lastOutput = 0.0;
}
void OnePole :: setNum(MY_FLOAT aValue)
{
    s gain = aValue;
}
void OnePole :: setDen(MY_FLOAT aValue)
{
    poleCoeff = -aValue;
}
void OnePole :: setPole(MY_FLOAT aValue)
{
    poleCoeff = aValue;
    if (poleCoeff > 0.0)            /* Normalize gain to 1.0 max */
      sgain = gain * (1.0 - poleCoeff);
    else
      sgain = gain * (1.0 + poleCoeff);
}
void OnePole :: setGain(MY_FLOAT aValue)
{
    gain = aValue;
    if (poleCoeff > 0.0)
      sgain = gain * (1.0 - poleCoeff); /* Normalize gain to 1.0 max */
    else
      sgain = gain * (1.0 + poleCoeff);
}
MY_FLOAT OnePole :: tick(MY_FLOAT sample) /* Perform Filter Operation */
{
    outputs[0] = (sgain * sample) + (poleCoeff * outputs[0]);
    lastOutput = outputs[0];
    return lastOutput;
}
/***************** Test Main *********************/
/*
#include< stdio.h>
void main()
{
    long i;
    OnePole test;
    test.setPole(0.99)
    for (i = 0; i < 150; i++) printf("%1f", test.tick(1.0));
    printf ("\n\n");
    test.clear();
    test.setPole(0.9);
    test.setGain(2.0);
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
    for (i=0; i<150; i++) printf("%1f", test.tick(0.5));
    printf("\n\n")
}
*/
```

One-Zero Filter

```
/* ---------------------------- onezero.h ------------------------- */
/*******************************************/
/* One Zero Filter Class,                  */
/* by Perry R. Cook, 1995–96               */
/* The parameter gain is an additional     */
/* gain parameter applied to the filter    */
/* on top of the normalization that takes  */
/* place automatically. So the net max     */
/* gain through the system equals the      */
/* value of gain. sgain is the combina-    */
/* tion of gain and the normalization      */
/* parameter, so if you set the poleCoeff  */
/* to alpha, sgain is always set to        */
/* gain / (1.0 - fabs(alpha)).             */
/*******************************************/
#include "filter.h"
class OneZero : public Filter
{
    protected:
      MY_FLOAT zeroCoeff;
      MY_FLOAT again;
    public:
      OneZero ();
      ~OneZero ();
      void clear ();
      void setGain(MY_FLOAT aValue);
      void setCoeff(MY_FLOAT aValue);
      MY_FLOAT tick(MY_FLOAT sample);
};
/* ---------------------------- onezero.cpp ------------------------- */
/*******************************************/
/* One Zero Filter Class,                  */
/* by Perry R. Cook, 1995–96               */
/* The parameter gain is an additional     */
/* gain parameter applied to the filter    */
/* on top of the normalization that takes  */
/* place automatically. So the net max     */
/* gain through the system equals the      */
/* value of gain. sgain is the combina-    */
/* tion of gain and the normalization      */
/* parameter, so if you set the poleCoeff  */
/* to alpha, sgain is always set to        */
/* gain / (1.0 - fabs(alpha)).             */
/*******************************************/
#include "onezero.h"
OneZero : : OneZero()
{
    gain = (MY_FLOAT) 1.0;
    zeroCoeff = (MY_FLOAT) 1.0;
    sgain = (MY_FLOAT) 0.5;
    inputs = (MY_FLOAT *) malloc(MY_FLOAT_SIZE);
    this->clear()
}
OneZero :: ~OneZero ()
{
    free(inputs);
}
void OneZero :: clear()
{
    inputs[0] = (MY_FLOAT) 0.0;
    lastOutput = (MY_FLOAT) 0.0;
}
void OneZero :: setGain(MY_FLOAT aValue)
{
    gain = aValue;
    if (zeroCoeff > 0.0)            /* Normalize gain to 1.0 max */
      sgain = gain / ((MY_FLOAT) 1.0 + zeroCoeff);
    else
      sgain = gain / ((MY_FLOAT) 1.0 – zeroCoeff);
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
}
void OneZero :: setCoeff(MY_FLOAT aValue)
{
    zeroCoeff = aValue;
    if (zeroCoeff > 0.0)            /* Normalize gain to 1.0 max */
      sgain = gain / ((MY_FLOAT) 1.0 + zeroCoeff);
    else
      sgain = gain / ((MY_FLOAT) 1.0 – zeroCoeff);
}
MY FLOAT OneZero :: tick(MY_FLOAT sample) /* Perform Filter Operation */
{
    MY_FLOAT temp;
    temp = sgain * sample;
    lastOutput = (inputs[0] * zeroCoeff) + temp;
    inputs[0] =temp;
    return lastOutput;
}
```

BiQuad (Two-Pole, Two-Zero) Filter

```
/* ---------------------------- biquad.h ---------------------------- */
/*****************************************/
/* BiQuad (2-pole, 2-zero) Filter Class,   */
/* by Perry R. Cook, 1995–96               */
/* See books on filters to understand      */
/* more about how this works. Nothing      */
/* out of the ordinary in this version.    */
/*****************************************/
#include "filter.h"
class BiQuad : public Filter
{
    protected:
      MY_FLOAT poleCoeffs[2];
      MY_FLOAT zeroCoeffs[2];
    public:
      BiQuad();
      ~BiQuad();
      void clear();
      void setA1(MY_FLOAT a1);
      void setA2(MY_FLOAT a2);
      void setB1(MY_FLOAT b1);
      void setB2(MY_FLOAT b2);
      void setPoleCoeffs(MY_FLOAT *coeffs);
      void setZeroCoeffs(MY_FLOAT *coeffs);
      void setGain(MY_FLOAT aValue);
      void setFreqAndReson(MY_FLOAT freq, MY_FLOAT reson);
      void setEqualGainZeroes();
      MY_FLOAT tick(MY_FLOAT sample);
};
/* ---------------------------- biquad.cpp ------------------ */
/*****************************************/
/* BiQuad (2-pole, 2-zero) Filter Class,   */
/* by Perry R. Cook, 1995–96               */
/* See books on filters to understand      */
/* more about how this works. Nothing      */
/* out of the ordinary in this version.    */
/*****************************************/
#include "biquad.h"
BiQuad :: BiQuad() : Filter()
{
    inputs = (MY_FLOAT *) calloc(2 , MY_FLOAT_SIZE);
    zeroCoeffs[0] = 0.0;
    zeroCoeffs[1] = 0.0;
    poleCoeffs[0] = 0.0;
    poleCoeffs[1] = 0.0;
    gain = 1.0;
    this–>clear();
}
BiQuad :: ~BiQuad()
{
    free(inputs)
}
void BiQuad :: clear()
{
    inputs[0] = 0.0;
    inputs[1] = 0.0;
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
    lastOutput = 0.0;
}
void BiQuad :: setA1(MY_FLOAT a1)
{
    poleCoeffs[0] = -a1;
}
void BiQuad :: setA2(MY_FLOAT a2)
{
    poleCoeffs[1] = -a2;
}
void BiQuad :: setB1 (MY_FLOAT b1)
{
    zeroCoeffs[0] = b1;
}
void BiQuad :: setB2(MY_FLOAT b2)
{
    zeroCoeffs[1] = b2;
}
void BiQuad :: setPoleCoeffs(MY_FLOAT *coeffs)
{
    poleCoeffs[0] = coeffs[0];
    poleCoeffs[1] = coeffs[1];
}
void BiQuad :: setZeroCoeffs(MY_FLOAT *coeffs)
{
    zeroCoeffs[0] = coeffs[0];
    zeroCoeffs[1] = coeffs[1];
}
void BiQuad :: setFreqAndReson(MY_FLOAT freq, MY_FLOAT reson)
{
    poleCoeffs[1] = - (reson * reson);
    poleCoeffs[0] = 2.0 * reson * cos(TWO_PI * freq / SRATE);
}
void BiQuad :: setEqualGainZeroes()
{
    zeroCoeffs[1] = -1.0;
    zeroCoeffs[0] = 0.0;
}
void BiQuad :: setGain(MY_FLOAT aValue)
{
 if (aValue == 0)
    fprintf(stderr,"*** BiQuad: Gain set to zero!\n");
 gain = aValue;
}
MY_FLOAT BiQuad :: tick(MY_FLOAT sample)        /*      Perform Filter Operation
*/
{                                                       /* Biquad is two pole, two zero filter
*/
    register MY_FLOAT temp;             /* Look it up in your favorite DSP text
*/
    temp = sample * gain;                   /* Here's the math for the      */
    temp += inputs[0] * poleCoeffs[0];      /* version which implements     */
    temp += inputs[1] * poleCoeffs[1];      /* only 2 state variables       */
    lastOutput = temp;                      /* This form takes              */
    lastOutput += (inputs[0] * zeroCoeffs[0]); /* 5 multiplies and          */
    lastOutput += (inputs[1] * zeroCoeffs[1]); /* 4 adds                    */
    inputs[1] = inputs[0];                  /* and 3 moves                  */
    inputs[0] = temp;                       /* like the 2 state-var form    */
    return lastOutput;
}
```

Non-Interpolating Delay-Line

```
/* ------------------------------ dlinen.h --------------------------- */
/*********************************************/
/* Non-Interpolating Delay Line          */
/* Object by Perry R. Cook 1995-96       */
/* This one uses a delay line of maximum */
/* length specified on creation. A non-  */
/* interpolating delay line should be    */
/* used in non-time varying (reverb) or  */
/* non-critical (????) applications.     */
/*********************************************/
/* 1997/98/jos - added energy, current*, contents*, and delay methods */
#include "filter.h"
class DLineN : public Filter
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
{
    protected:
      long inPoint;
      long outPoint;
      long length;
      MY_FLOAT currentDelay;
    public:
      DLineN(long max_length);
      ~DLineN();
      void clear();
      void setDelay(MY_FLOAT length);
      MY_FLOAT tick(MY_FLOAT sample);
      MY_FLOAT energy(void);
      long currentInPoint (void);
      long currentOutpoint(void);
      MY_FLOAT contentsAt(int n);
      MY_FLOAT contentsAtNowMinus(int n);
      MY_FLOAT delay(void);
};
/* ---------------------------- dlinen.cpp ---------------------------- */
/*********************************************/
/* Non-Interpolating Delay Line              */
/* Object by Perry R. Cook 1995–96           */
/* This one uses a delay line of maximum     */
/* length specified on creation. A non-      */
/* interpolating delay line should be        */
/* used in non-time varying (reverb) or      */
/* non-critical (????) applications.         */
/*********************************************/
/* 1997/98/jos - added energy, current*, contents*, and delay methods */
#include "dLinen.h"
DLineN :: DLineN(long max_length)
{
    length = max_length;
    inputs = (MY_FLOAT *) malloc(length * MY_FLOAT_SIZE);
    inPoint = 0;
    outPoint = 0;
    this->clear()
    this->setDelay(length * 0.5);
}
DLineN :: ~DLineN()
{
    free(inputs);
}
void DLineN :: clear(void)
{
    long i;
    for (i=0;i<length;i++) inputs[i] = (MY_FLOAT) 0.0;
    lastOutput = (MY_FLOAT) 0;
}
void DLineN :: setDelay(MY_FLOAT lag)
{
    if (lag<0 || lag >= length)
      fprintf(stderr, "*** DLineN: setDelay: value %f out of range.\n", lag);
    long roundedLag = (long)lag;
    outpoint = inPoint - roundedLag;          /* read chases write      */
    while (outPoint<0) outpoint += length;    /* modulo maximum length  */
    currentDelay = (MY_FLOAT) roundedLag;
}
MY_FLOAT DLineN :: delay(void)
{
    return currentDelay;
}
MY_FLOAT DLineN :: tick(MY_FLOAT sample)          /* Take one, yield one      */
{
    inputs[inPoint++] = sample;                   /* Input next sample        */
    if (inPoint == length)                        /* Check for end            */
                                                  condition
      inPoint -= length;
    lastOutput = inputs[outPoint++];              // first 1/2 of              */
                                                  interpolation
    if (outPoint>=length)          {              // Check for end            */
                                                  condition
      outpoint -= length;
    }
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
    return lastOutput;
}
MY_FLOAT DLineN :: energy(void)
{
        int i;
        register MY_FLOAT e = 0;
        if (inPoint>=outPoint) {
          for (i=outPoint;i<inPoint;i++) {
            register MY_FLOAT t = inputs[i];
            e += t*t;
          }
        } else {
          for (i=outPoint;i<length;i++) {
            register MY_FLOAT t = inputs[i];
            e += t*t;
          }
          for (i=0;i<inPoint;i++) {
            register MY_FLOAT t = inputs[i];
            e += t*t;
          }
        }
        return e;
}
long DLineN :: currentInPoint(void)
{
    return inPoint;
}
long DLineN :: currentOutPoint(void)
{
    return outPoint;
}
MY_FLOAT DLineN :: contentsAt(int n)
{
    int i = n;
    if (i<0) i=0;
    if (i>= length) i = length-1;
    if (i != n) {
      fprintf (stderr,
        "*** dlinen.cpp: contentsAt(%d) overflows length %d delay line\n",
        n,length);
    }
    return inputs[i];
}
MY_FLOAT DLineN :: contentsAtNowMinus(int n)
    /* "Now" is always where inPoint points which is not yet written. */
    /* outPoint points to "now - delay". Thus, valid values for n are 1 to delay. */
{
    int i = n;
    if (i<1) i=1:
    if (i>length) i = length;
    if (i != n) {
      fprintf (stderr,
        "*** dlinen.cpp: contentsAtNowMinus(%d) overflows length %d delay line\n"
          "Clipped\n", n, length);
    }
    int ndx = inPoint-i;
    if (ndx < 0) { /* Check for wraparound */
      ndx += length;
      if (ndx < 0 || ndx >= length)
        fprintf(stderr, "*** dlinen.cpp: contentsAtNowMinus(): can't happen\n");
    }
    return inputs [ndx];
}
/*************** Test Main Program ****************/
/*
void main()
{
    DLineN delay(140);
    FILE *fd;
    MY_FLOAT temp;
    short data;
    long i;
    fd = fopen("test.raw", "wb");
    delay.setDelay(128);
    for (i=0; 1<4096; i++) {
```

APPENDIX E-continued

SOURCE LISTINGS FOR ALL MODIFIED STK UTILITIES
These software utilities are modified versions of the ones contained in the Synthesis Tool Kit (STK) as it is presently distributed

```
        if (i%256 != 0) temp = 0.0; else temp = 1.0;
        data = (temp + delay.tick(temp)) * 16000.0;
        fwrite(&data,2,1,fd);
    }
    delay.setDelay(64.5);
    for (i=0;i<4096;i++) {
        if (i%256 != 0) temp = 0.0; else temp = 1.0;
        data = (temp + delay.tick(temp)) * 16000.0;
        fwrite(&data,2,1,fd);
    }
    fclose(fd);
}
*/
```

Filter Superclass

```
/* ---------------------------- filter.h ---------------------------- */
/*****************************************************/
/* Filter Class, by Perry R. Cook, 1995–96     */
/* This is the base class for all filters.     */
/* To me, most anything is a filter, but       */
/* I'll be a little less general here, and     */
/* define a filter as something which has      */
/* input(s), output(s), and gain.              */
/*************************************************/
#include "object.h"
class Filter : public Object
{
    protected:
        MY_FLOAT gain;
        MY_FLOAT *outputs;
        MY_FLOAT *inputs;
        MY_FLOAT lastOutput;
    public:
        Filter()
        virtual ~Filter ();
        MY_FLOAT lastOut();
        virtual MY_FLOAT tick(MY_FLOAT input);
        virtual void clear(void);
        virtual void setPole(MY_FLOAT thePole); /* OnePole needs it */
};
/* ---------------------------- filter.cpp ---------------------------- */
/*************************************************/
/* Filter Class, by Perry R. Cook, 1995–96     */
/* This is the base class for all filters.     */
/* To me, most anything is a filter, but       */
/* I'll be a little less general here, and     */
/* define a filter as something which has      */
/* input(s), output(s), and gain.              */
/*************************************************/
#include "filter.h"
Filter :: Filter() : Object()
{
}
Filter :: ~Filter()
{
}
MY_FLOAT Filter :: lastOut()
{
    return lastOutput;
}
MY_FLOAT Filter :: tick(MY_FLOAT input)
{
    fprintf(stderr, "Filter: tick() not defined in subclass!\n")
    lastOutput = input;    /* Null filter */
    return lastOutput;
}
void Filter :: clear(void)
{
    fprintf(stderr, "Filter: tick() not defined in subclass!\n");
}
void Filter :: setPole(MY_FLOAT thePole)
{
    fprintf(stderr, "Filter: setPole() called yet not defined in subclass!\n");
}
```

What is claimed is:

1. An electronic tone synthesis circuit for synthesizing a tone resembling that produced by a wind instrument having an acoustic tube bore, the circuit comprising:

a) an input for receiving an excitation signal;

b) a delay for delaying a digital signal;

c) an infinite-impulse-response (IIR) filter for digitally filtering the digital signal;

d) an output for providing a digital output representing a synthesized tone; and e) a filter truncation circuit for truncating an impulse response of the IIR filter after a predetermined number of samples;

wherein:

i) the delay and filter are connected in series with feedback to form a filtered delay loop;

ii) the input injects the excitation signal into the filtered delay loop;

iii) the output extracts the digital signal from the filtered delay loop; and iv) the delay and filter introduce a total time delay of the digital signal, wherein the total time delay is inversely proportional to an approximate pitch of the synthesized tone.

2. The circuit of claim 1 further comprising resetting circuitry to reset the filter to eliminate accumulated round-off errors arising in part from the presence of one or more unstable poles in the filter.

3. The circuit of claim 2 wherein the resetting circuitry includes a second filter.

4. The circuit of claim 3 wherein the second filter is chosen from the group consisting of an IIR filter and a truncated infinite impulse response (TIIR) filter.

5. The circuit of claim 3 wherein the resetting circuitry operates only as necessary to achieve a predetermined minimal accuracy.

6. The circuit of claim 1 wherein the delay comprises a plurality of delay elements distributed throughout the filtered delay loop.

7. The circuit of claim 1 wherein the filtered delay loop comprises sub-loops representing sections of the wind instrument.

8. The circuit of claim 1 wherein the IIR filter has an impulse response approximately equal to the sum of an exponential and a constant.

9. The circuit of claim 1 wherein the IIR filter has an impulse response approximately equal to a polynomial.

10. The circuit of claim 1 wherein the truncating circuit comprises:

i) a second IIR filter having the same poles as the IIR filter, whereby the second IIR filter generates a copy of a "tail" of the IIR filter; and ii) a subtractor coupled to the IIR filter and the second IIR filter, whereby the subtractor subtracts the copy of the tail from an impulse response of the IIR filter.

11. The apparatus of claim 1 wherein the IIR filter includes at least one unstable pole.

12. A method for electronically synthesizing a tone resembling that produced by a wind instrument having an acoustic tube bore, the method comprising:

a) providing an excitation signal;

b) combining the excitation signal with a digital signal propagating in a filtered delay loop;

c) delaying the digital signal propagating in the filtered delay loop by a total delay inversely proportional to the approximate pitch of the synthesized tone;

d) digitally filtering the digital signal propagating in the filtered delay loop using an infinite impulse response (IIR) filter having at least one unstable pole;

e) outputting the digital signal from the filtered delay loop to produce the synthesized tone; and f) truncating an impulse response of the IIR filter after a predetermined number of samples, thereby implementing a truncated infinite impulse response (TIIR) filter.

13. The method of claim 12 wherein digitally filtering the digital signal includes repeatedly resetting the filter to eliminate accumulated round-off errors associated with the presence of one or more unstable poles in the filter.

14. The method of claim 13 wherein digitally filtering the digital signal further includes using a second filter.

15. The method of claim 14 wherein the second filter is chosen from the group consisting of an IIR filter and a TIIR filter.

16. The method of claim 13 wherein resetting the filter occurs only as necessary to achieve a predetermined minimal accuracy.

17. The method of claim 13 wherein digitally filtering the digital signal further includes interchangeably using a plurality of substantially equivalent filters.

18. The method of claim 12 further comprising scattering the digital signal at scattering junctions in the filtered delay loop, where the scattering junctions divide the loop into sub-loops representing sections of the wind instrument.

19. The method of claim 12 wherein the IIR filter has an impulse response approximately equal to the sum of an exponential and a constant.

20. The method of claim 12 wherein the IIR filter has an impulse response approximately equal to a polynomial.

21. The method of claim 12 wherein the impulse response of the IIR filter is truncated by generating a copy of a tail of an impulse response of the IIR filter and subtracting the copy of the tail from the impulse response.

22. The method of claim 12 wherein the IIR filter has at least one unstable pole.

* * * * *

UNITED STATES PATENT AND TRADEMARK OFFICE

CERTIFICATE OF CORRECTION

PATENT NO. : 6,284,965 B1 
DATED : September 4, 2001
INVENTOR(S) : Julius O. Smith, III and Maarten Van Walstijn It is certified that error appears in the above-identified patent and that said Letters Patent is hereby corrected as shown below:

Title page,
Item [73], change the assignee to -- Analog Devices, Inc., Norwood, MA (US) --.

Signed and Sealed this

Thirteenth Day of August, 2002

*Attest:*

*Attesting Officer*

JAMES E. ROGAN
*Director of the United States Patent and Trademark Office*